US007370476B2

(12) United States Patent
Kawamura et al.

(10) Patent No.: US 7,370,476 B2
(45) Date of Patent: May 13, 2008

(54) PUMP SYSTEM, CHARGE RELIEF MECHANISM AND OIL PRESSURE CONTROL MECHANISM

(75) Inventors: Masahisa Kawamura, Hyogo (JP); Nobuhisa Kamikawa, Hyogo (JP); Takeaki Nozaki, Hyogo (JP); Kengo Sasahara, Hyogo (JP)

(73) Assignee: Kanzaki Kokyukoki Mfg. Co., Ltd., Hyogo (JP)

( * ) Notice: Subject to any disclaimer, the term of this patent is extended or adjusted under 35 U.S.C. 154(b) by 281 days.

(21) Appl. No.: 11/150,250

(22) Filed: Jun. 13, 2005

(65) Prior Publication Data

US 2006/0008357 A1 Jan. 12, 2006

(30) Foreign Application Priority Data

Jul. 9, 2004 (JP) ..... 2004-202643

(51) Int. Cl.
*F16D 31/02* (2006.01)

(52) U.S. Cl. ..... 60/486

(58) Field of Classification Search ..... 60/486
See application file for complete search history.

(56) References Cited

U.S. PATENT DOCUMENTS 3,232,056 A * 2/1966 Heinrich et al. ..... 60/484
3,241,319 A 3/1966 Andrews
6,425,244 B1 * 7/2002 Ohashi et al. ..... 60/486
6,672,843 B1 * 1/2004 Holder et al. ..... 60/486
6,953,327 B1 * 10/2005 Hauser et al. ..... 60/486

FOREIGN PATENT DOCUMENTS

EP 1 350 421 10/2003

* cited by examiner

*Primary Examiner*—F. Daniel Lopez
(74) *Attorney, Agent, or Firm*—Sterne, Kessler, Goldstein & Fox, P.L.L.C.

(57) ABSTRACT

There is provided a pump system including; a plurality of hydraulic pump bodies arranged in parallel; a plurality of pump shafts respectively driving the plurality of hydraulic pump bodies; a power transmission mechanism operatively connecting the plurality of pump shafts; and a pump case which accommodating the plurality of hydraulic pump bodies and the power transmission mechanism, and supports the plurality of pump shafts in a rotatable manner about an axis line, the pump case including a port block formed with supply/discharge oil passages for the plurality of pump bodies. One pump shaft of the plurality of pump shafts has a first end extending outward from the pump case so as to form an input end operatively connected to a driving source. The one pump shaft is directly or indirectly supported by the pump case at a region which is closer to the input end via a plurality of bearing members.

4 Claims, 17 Drawing Sheets

PUMP SYSTEM, CHARGE RELIEF MECHANISM AND OIL PRESSURE CONTROL MECHANISM

BACKGROUND OF THE INVENTION

1. Field of the Invention

The present invention relates to a pump system having hydraulic pump bodies arranged in parallel, a charge relief mechanism and an oil pressure control mechanism.

2. Related Art

A pump system comprising a plurality of hydraulic pump bodies arranged in parallel with respect to each other, and forming a transmission path in cooperation with a hydraulic actuator such as a hydraulic motor unit arranged spaced apart from and fluidly connected with the pump system, has been used in various fields of a travel transmission mechanism of a working vehicle and the like (see, for example, U.S. Pat. No. 6,425,244).

Specifically, such a conventional pump system includes a plurality of hydraulic pump bodies arranged in parallel, a plurality of pump shafts respectively driving the plurality of hydraulic pump bodies, a power transmission mechanism for operatively connecting the plurality of pump shafts with respect to each other, and a pump case for accommodating the plurality of hydraulic pump bodies and the power transmission mechanism and, also, supporting the plurality of pump shafts in a rotatable manner about an axis line.

The pump case has a center section (or port block), with which the plurality of hydraulic pump bodies are brought into contact in a rotabable manner. The port block forms a supply/discharge oil passage for the plurality of hydraulic pump bodies therein.

One of the pump shafts of the plurality of pump shafts has one end which is supported to the pump case so as to extend outward and is operatively connected to a driving source via a transmission mechanism such as a pulley.

The conventional pump system has a possibility that a sliding face of one hydraulic pump body driven by one pump shaft is tilt with respect to an inner surface (a face facing the hydraulic pump body) of the port block.

In other words, a force in a direction orthogonal to an axis line direction is applied to the one pump shaft operatively connected to the driving source via the pulley or the like.

That is, the force orthogonal to the axis line direction is constantly applied to the one pump shaft, thereby causing this pump shaft to deflect.

The deflection of the one pump shaft causes an operating oil leak between the hydraulic pump body (hereinafter, referred to as one hydraulic pump body) driven by the one pump shaft and the port block, thus lowering transmission efficiency.

Further, in the case of using the conventional pump system as a travel transmission mechanism of a vehicle, the straight advancement of the vehicle degrades due to the operating oil leak.

That is, since the force in the orthogonal direction as described above does not act on the pump shafts other than the one pump shaft, the operating oil leak does not occur at the other hydraulic pump bodies (hereinafter, referred to as the other hydraulic pump bodies) driven by the other pump shafts.

Therefore, even when the hydraulic pump bodies are operated so that oil supply/discharge rates of the one hydraulic pump body and the other hydraulic pump bodies are the same to advance the vehicle straightly, the oil supply/discharge rates will differ due to the operating oil leak from the one hydraulic pump body, thus worsening the straight advancement of the vehicle.

The present invention has been made in view of the prior art, and one object of the present invention is to provide a pump system having a plurality of hydraulic pump bodies arranged in parallel and a plurality of pump shafts respectively driving the plurality of hydraulic pump bodies, and capable of preventing an operating oil leak from the hydraulic pump body driven by one pump shaft operatively connected to a driving source as much as possible.

SUMMARY OF THE INVENTION

According to the present invention, there is provided a pump system including; a plurality of hydraulic pump bodies arranged in parallel; a plurality of pump shafts respectively driving the plurality of hydraulic pump bodies;

a power transmission mechanism operatively connecting the plurality of pump shafts; and a pump case which accommodating the plurality of hydraulic pump bodies and the power transmission mechanism, and supports the plurality of pump shafts in a rotatable manner about an axis line, the pump case including a port block formed with supply/discharge oil passages for the plurality of pump bodies.

One pump shaft of the plurality of pump shafts has a first end extending outward from the pump case so as to form an input end operatively connected to a driving source. The one pump shaft is directly or indirectly supported by the pump case at a region which is closer to the input end via a plurality of bearing members.

With this configuration, the deflection of the one pump shaft can be suppressed as much as possible, and the amount of operating oil leak from the one hydraulic pump body driven by the one pump shaft can be suppressed.

Therefore, the disadvantage caused by lowering of a transmission efficiency of the one hydraulic pump body compared to the remaining hydraulic pump bodies can be effectively prevented.

Preferably, a sealing member is provided in a through hole which is formed in the pump case so that the one pump shaft is passed through. At least one of the plurality of bearing members is positioned outside of the sealing member.

The power transmission mechanism may have an input gear relatively non-rotatable with respect to the one pump shaft.

In one embodiment, the plurality of bearing members includes first and second bearing members which support the one pump shaft in a relatively rotatable manner with respect to the pump case. The first and second bearing members are arranged in series along the axial direction of the one pump shaft between the input gear and the input end.

In another embodiment, the plurality of bearing members include a first bearing member supporting the one pump shaft in a relatively rotatable manner with respect to the pump case, the first bearing member being arranged between the input gear and the input end, and a second bearing member supporting a driven pulley, which is provided in a relatively non-rotatable manner at the input end, in a relatively rotatable manner with respect to the pump case.

In the above various configurations, the pump case may include a case body which surrounds the plurality of hydraulic pump bodies and has an opening, through which the hydraulic pump bodies can be inserted, at an end face positioned on the opposite side of the input end of the one pump shaft, the port block detachably coupled to the case body so as to close the opening, and a lid member which is detachably coupled to the end face opposite the end face coupled to the port block of the case body and forms a space for accommodating the power transmission mechanism in cooperation with the case body.

Preferably, a charge pump body operatively driven by at least one pump shaft of the plurality of pump shafts is provided at the end face opposite the end face coupled to the case body of the port block.

The pump system with the charge pump body includes a pair of operating oil lines fluidly connecting the hydraulic pump body to a hydraulic actuator; a charge line having a first end which is communicated with a discharge side of the charge pump body, and a second end which is communicated with each of the pair of operating oil lines and which is inserted with a pair of check valves for allowing the oil to flow from the charge line to the pair of operating oil lines and for preventing backflow; and an oil pressure setting line having a first end which is fluidly connected to the charge line, and a second end which is fluidly connected to an oil reservoir and which is inserted with a charge relief valve.

The charge relief valve has a relief valve body which is provided in the oil pressure setting line so as to be movable in the axis line direction and block the oil pressure setting line by being seated on a valve seat provided in the oil pressure setting line; and an oil pressure setting relief spring pushing the relief valve body toward the valve seat.

The relief valve body is provided with a large diameter hole which is opened to the first end of the oil pressure setting line, a small diameter hole which is communicated with the large diameter hole and is opened to the second end of the oil pressure setting line, and a check valve seat formed between the large diameter hole and the small diameter hole.

The large diameter hole is provided with a check valve body which is seatable on the check valve seat and is movable in the axis line direction, and a slip-out prevention member for preventing the check valve body from being separated from the large diameter hole while allowing the check valve to selectively communicate or block between the large diameter hole and the small diameter hole.

According to another aspect of the present invention, there is provided a charge relief mechanism for setting an oil pressure of a charge line which replenishes operating oil to a pair of operating oil lines fluidly connecting a hydraulic pump body and a hydraulic actuator.

The charge relief mechanism according to the present invention includes an oil pressure setting line having a first end fluidly connected to the charge line and a second end fluidly connected to an oil reservoir; and a charge relief valve inserted in the oil pressure setting line.

The charge relief valve has a relief valve body which is provided in the oil pressure setting line so as to be movable in the axis line direction and blocks the oil pressure setting line by being seated on a valve seat provided in the oil pressure setting line; and an oil pressure setting relief spring pushing the relief valve body toward the valve seat.

The relief valve body is provided with a large diameter hole opened to the first end of the oil pressure setting line, a small diameter hole which communicates with the large diameter hole and is opened to the second end of the oil pressure setting line, and a check valve seat formed between the large diameter hole and the small diameter hole.

The large diameter hole is provided with a check valve body which is seatable on the check valve seat and is movable in the axis line direction, and a slip-out prevention member for preventing the check valve body from being separated from the large diameter hole while allowing the check valve body to selectively communicate or block between the large diameter hole and the small diameter hole.

With this configuration, a charge pressure setting function for setting the oil pressure of the charge line can be performed, and in case that one of the pair of operating oil lines becomes a negative pressure when, for example, the engine stops, a replenishing oil function for replenishing oil from the oil reservoir to the operating oil line on the negative pressure side can be automatically performed, thereby effectively preventing a free wheel phenomenon.

According to still another aspect of the present invention, there is provided an oil pressure control mechanism applied to a pair of first and second operating oil lines fluidly connecting a hydraulic pump body and a hydraulic actuator so as to relieve an oil pressure of the first or second operating oil lines to the remaining oil pressure line when the oil pressure of the first or second operating oil lines exceeds a predetermined value.

The oil pressure control mechanism has a relief line including a large diameter hole which is opened to the first operating oil line, a small diameter hole which communicates with the large diameter hole and which is opened to the second operating oil line, and a valve seat formed between the large diameter hole and the small diameter hole; and a relief valve inserted in the relief line.

The relief valve includes a relief valve body which is provided in the relief line so as to be movable in an axis line direction and blocks the relief line by being seated on the valve seat provided in the relief line; a relief spring having a tip end engaged with the relief valve body so as to push the relief valve body toward the valve seat; and a spring holding member which is engaged with a base end of the relief spring and defines a space for accommodating the relief spring in a state that the relief spring generates a biasing force corresponding to a relief setting value.

The relief valve body is provided with a first pressure receiving face for pushing the relief valve body away from the valve seat against the biasing force of the relief spring when receiving an oil pressure of the first operating oil line, and a second pressure receiving face for pushing the relief valve body away from the valve set against the biasing force of the relief spring when receiving an oil pressure of the second operating line.

The spring holding member can change a holding position of the base end of the relief spring so as to expand the space to have the relief spring in a state equal to or more than a free length.

With this configuration, a bidirectional relief function between the pair of operating oil lines and a bypass action for bypassing between the pair of operating oil lines can be selectively achieved by simply operating the spring holding member.

BRIEF DESCRIPTION OF THE DRAWINGS

The above, and other objects, features and advantages of the present invention will become apparent from the detailed description thereof in conjunction with the accompanying drawings wherein.

DETAILED DESCRIPTION OF THE PREFERRED EMBODIMENTS

Embodiment 1

Hereinafter, one preferred embodiment of a pump system according to the present invention will be described with reference to the accompanying drawings.

Figure 1:
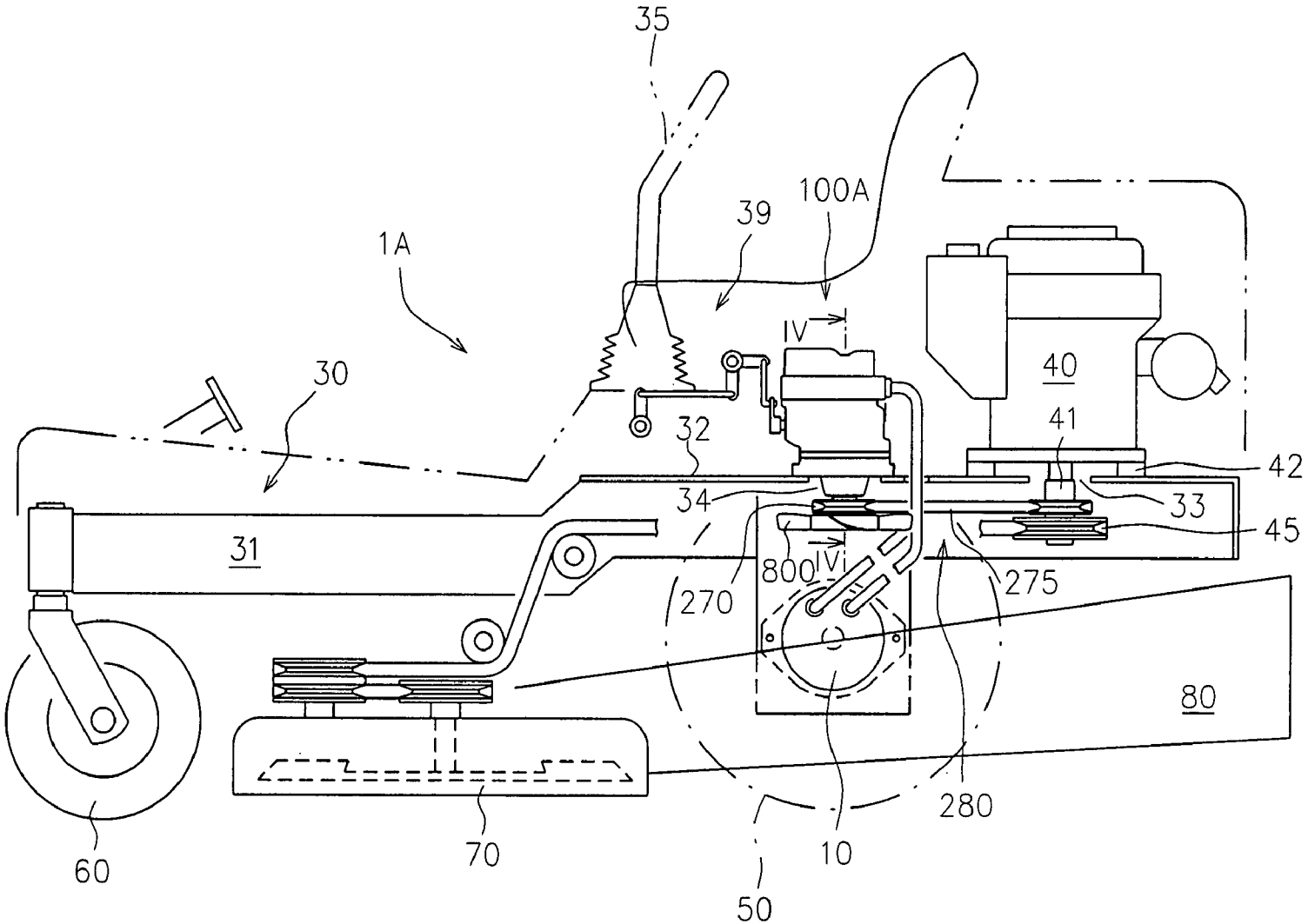
FIG. 1 is a side view of a working vehicle to which a pump system according to a first embodiment of the present invention is applied.
Figure 2:
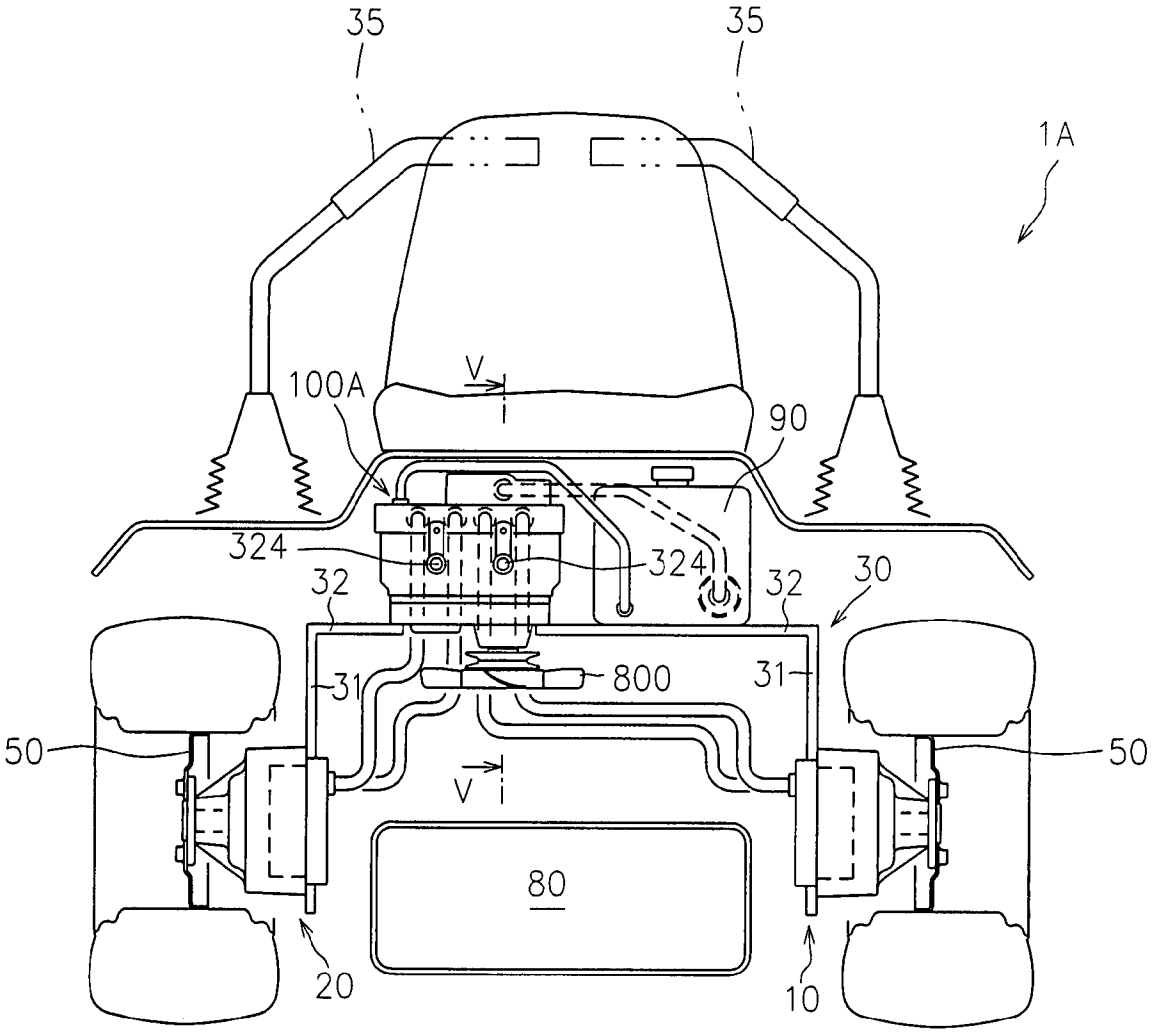
FIG. 2 is a front view of the working vehicle shown in FIG. 1.
Figure 3:
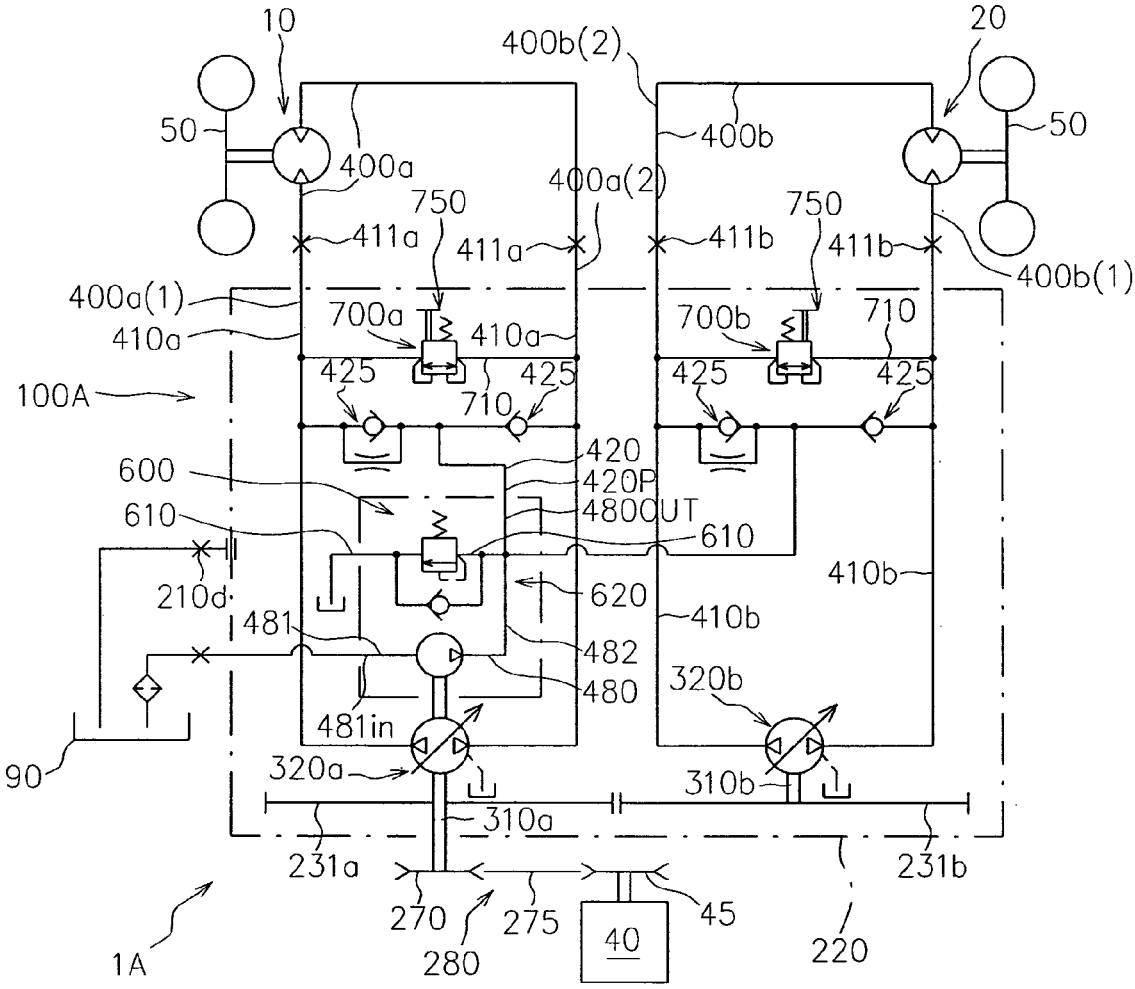
FIG. 3 is a hydraulic circuit diagram of the working vehicle shown in FIGS. 1 and 2.

FIGS. 1 and 2 are respectively a side view and a front view of a working vehicle 1A to which a pump system 100A according to this embodiment is applied. FIG. 3 is a hydraulic circuit diagram of the working vehicle 1A.

As shown in FIGS. 1 to 3, the pump system 100A according to this embodiment is used as a travel transmission mechanism of the working vehicle 1A.

Specifically, as shown in FIGS. 1 to 3, the working vehicle 1A includes a vehicle frame 30, a driving source 40 mounted to a rear of the vehicle frame 30, the pump system 100A operatively connected to the driving source 40, a pair of first and second hydraulic motor units 10, 20 fluidly connected to the pump system 100A via a pair of first operating oil lines 400*a* and a pair of second operating oil lines 400*b*, and a pair of left and right driving wheels 50 respectively driven by the pair of first and second hydraulic motor units 10, 20.

Herein, reference numerals 60, 70, and 80 in FIG. 1 and/or FIG. 2 denote caster wheels, a mower operatively driven by the driving source 40 and a discharge duct forming a conveyance path for the grass reaped by the mower 70.

The pump system 100A configures the travel speed change transmission mechanism in cooperation with the pair of first and second hydraulic motor units 10, 20 of the working vehicle 1A.

Specifically, at least one of the pump system 100A and the first and second hydraulic motor units 10, 20 is (are) of a variable displacement type so as to form an HST. The HST forms a part of the travel transmission mechanism.

In this embodiment, first and second hydraulic pump bodies of the pump system 100A are of a variable displacement type, and the first and second hydraulic motor units 10 and 20 are of a fixed displacement type.

As shown in FIGS. 1 and 2, the vehicle frame 30 has a pair of left and right main frames 31 extending in a longitudinal direction of the vehicle, and a cross member 32 for connecting the pair of main frames 31.

The driving source 40 is, for example, an internal combustion engine, and as shown in FIG. 1, has a structure of being mounted with a driving shaft 41 thereof extending in the vertical direction.

More specifically, as shown in FIG. 1, the driving source 40 is mounted on the rear side of the cross member 32 via an elastic member 42 so that a shaft end of the driving shaft 41 extends below the cross member 32.

That is, the cross member 32 has a first opening 33 at a portion corresponding to the driving source 40, as shown in FIG. 1.

The driving source 40 is attached to the upper face of the cross member 32 via the elastic member 42 so that the shaft end of the driving shaft 41 extends below the cross member 32 through the first opening 33, and the driving pulley 45 attached to the shaft end is positioned below the cross member 32.

The pump system 100A is mounted on the upper face of the vehicle frame 30 while being operatively connected to the driving source 40.

Figure 4:
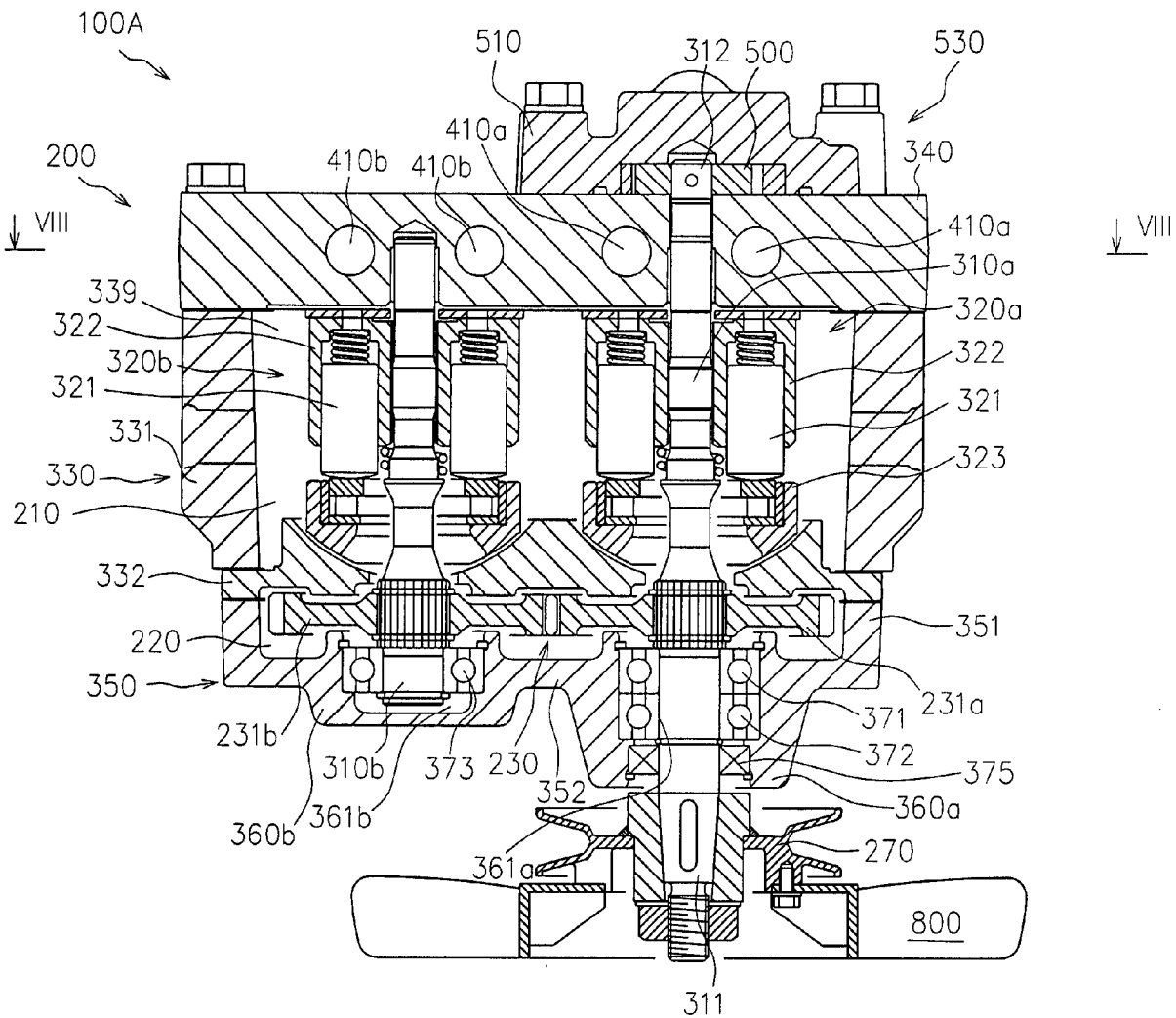
FIG. 4 is a longitudinal front view of the pump system taken along line IV-IV in FIG. 1
Figure 5:
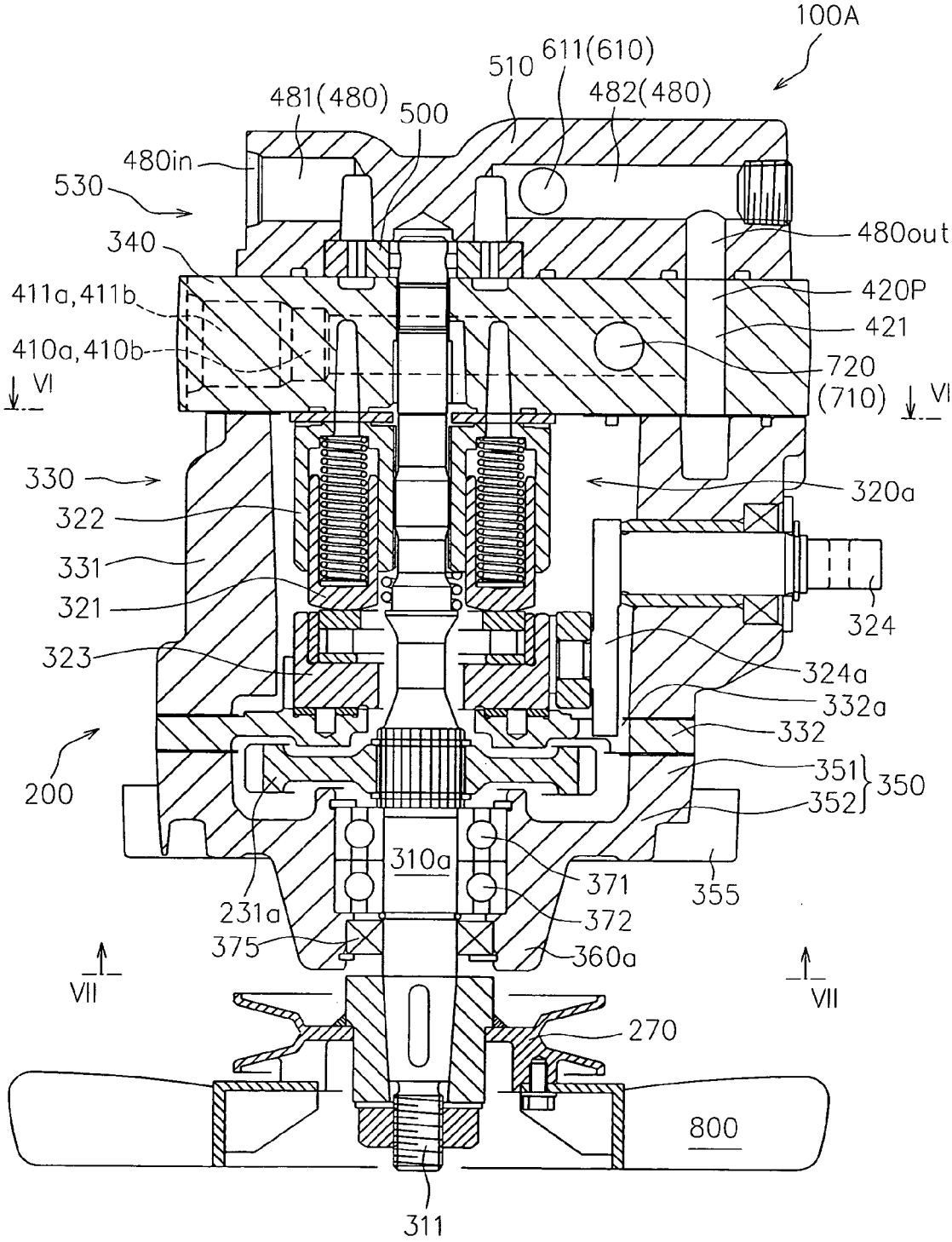
FIG. 5 is a longitudinal side view of the pump system taken along line V-V in FIG. 2.

FIG. 4 is a longitudinal front view of the pump system 100A taken along line IV-IV in FIG. 1. FIG. 5 is a longitudinal side view of the pump system 100A taken along line V-V in FIG. 2.

As shown in FIGS. 4 and 5, the pump system 100A according to this embodiment includes the first and second hydraulic pump bodies 320*a*, 320*b* arranged in parallel, first and second pump shafts 310*a*, 310*b* respectively driving the first and second hydraulic pump bodies 320*a*, 320*b*, a power transmission mechanism 230 for operatively connecting the first and second pump shafts 310*a*, 310*b*, and a pump case 200 for accommodating the first and second hydraulic pump bodies 320*a*, 320*b* as well as the power transmission mechanism 230 and, also, supporting the first and second pump shafts 310*a*, 310*b* in a rotatable manner about the axis line.

The first pump shaft 310*a* has one end extending outward from the pump case 200 so as to form an input end 311 operatively connected to the driving source 40.

In this embodiment, the driving source 40 is of a vertical crankshaft type, and the first pump shaft 310*a* has a lower end projecting outward from the pump case 200 in the vertical direction, as described above.

More specifically, a second opening 34 that allows the input end 311 (lower end in this embodiment) of the first pump shaft 310*a* to be passed through is formed in the cross member 32 in front of the first opening 33 (see FIGS. 1 and 2).

The pump case 200 is fixed at the upper face of the cross member 32 with the input end 311 of the first pump shaft 310*a* passed through the second opening 34 from above and positioned below the cross member 32. Alternatively, the pump case 200 may also be fixed and suspended from the lower face of the cross member 32.

A driven pulley 270 is supported in a relatively non-rotatable manner at the input end 311 of the first pump shaft 310*a*.

As shown in FIGS. 4 and 5, in this embodiment, a cooling fan 800 is supported at the input end 311 of the first pump shaft 310*a* in a relatively non-rotatable manner, and the driven pulley 270 is connected to the cooling fan 800 by means of a fastening member such as a bolt.

As shown in FIGS. 1 and 2, a belt 275 is wound around the driving pulley 45 and the driven pulley 270 so that the power is transmitted from the driving source 40 to the first pump shaft 310*a* via the belt 275.

That is, the driving pulley 45, the driven pulley 270 and the belt 275 form a pulley transmission mechanism 280 for transmitting the power from the output shaft 41 of the driving source 40 to the first pump shaft 310*a*.

The second pump shaft 310*b* is supported by the pump case 200 so as to be substantially parallel to the first pump shaft 310*a*.

As described above, in this embodiment, the first pump shaft 310*a* is arranged in the vertical direction with the pump system 100A mounted on the vehicle. Thus, the second pump shaft 310*b* is also arranged in the vertical direction with the pump system 100A mounted on the vehicle.

The power transmission mechanism 230 is configured to transmit the power from the first pump shaft 310*a* to the second pump shaft 310*b*.

As shown in FIGS. 4 and 5, in this embodiment, the power transmission mechanism 230 has a first gear 231*a* which is relatively non-rotatable with respect to the first pump shaft 310*a*, and a second gear 231*b* which is relatively non-rotatable with respect to the second pump shaft 310*b* and is meshed with the first gear 231*a*.

In this embodiment, the first and second gears 231*a*, 231*b* are spur gears (see FIG. 4), but noise can be reduced if made as helical gears.

The first and second hydraulic pump bodies 320*a*, 320*b* are respectively driven by the first and second pump shafts 310*a*, 310*b*.

The first and second hydraulic pump bodies 320*a*, 320*b* substantially have the same configuration.

Therefore, the detailed description of the second hydraulic pump body 320*b* will be omitted.

As shown in FIGS. 4 and 5, the first hydraulic pump body 320*a* has a piston unit 321 for reciprocating with the rotation of the first pump shaft 310*a*, and a cylinder block 322 for supporting the piston unit 321 in a reciprocatable manner.

In this embodiment, the first hydraulic pump body 320*a* is of a variable displacement type, as described above.

Therefore, in addition to the aforementioned configuration, the first pump body 320*a* comprises an output-adjusting member 323 for adjusting the suction/discharge rates by changing a reciprocating range of the piston unit 321.

In this embodiment, a cradle-type movable swash plate is used as the output-adjusting member 323, and a shoe provided at a tip end of the piston unit 321 is brought into contact therewith.

The output-adjusting member 323 is externally operable by a control shaft 324. In this embodiment, an arm 324*a* having a free end engaged with the output-adjusting member 323 and a proximal end connected to the control shaft 324 in a non-rotatable manner is provided (see FIG. 5). That is, when the control shaft 324 rotates about the axis line, the output-adjusting member 323 slants via the arm 324*a*.

Figure 6:
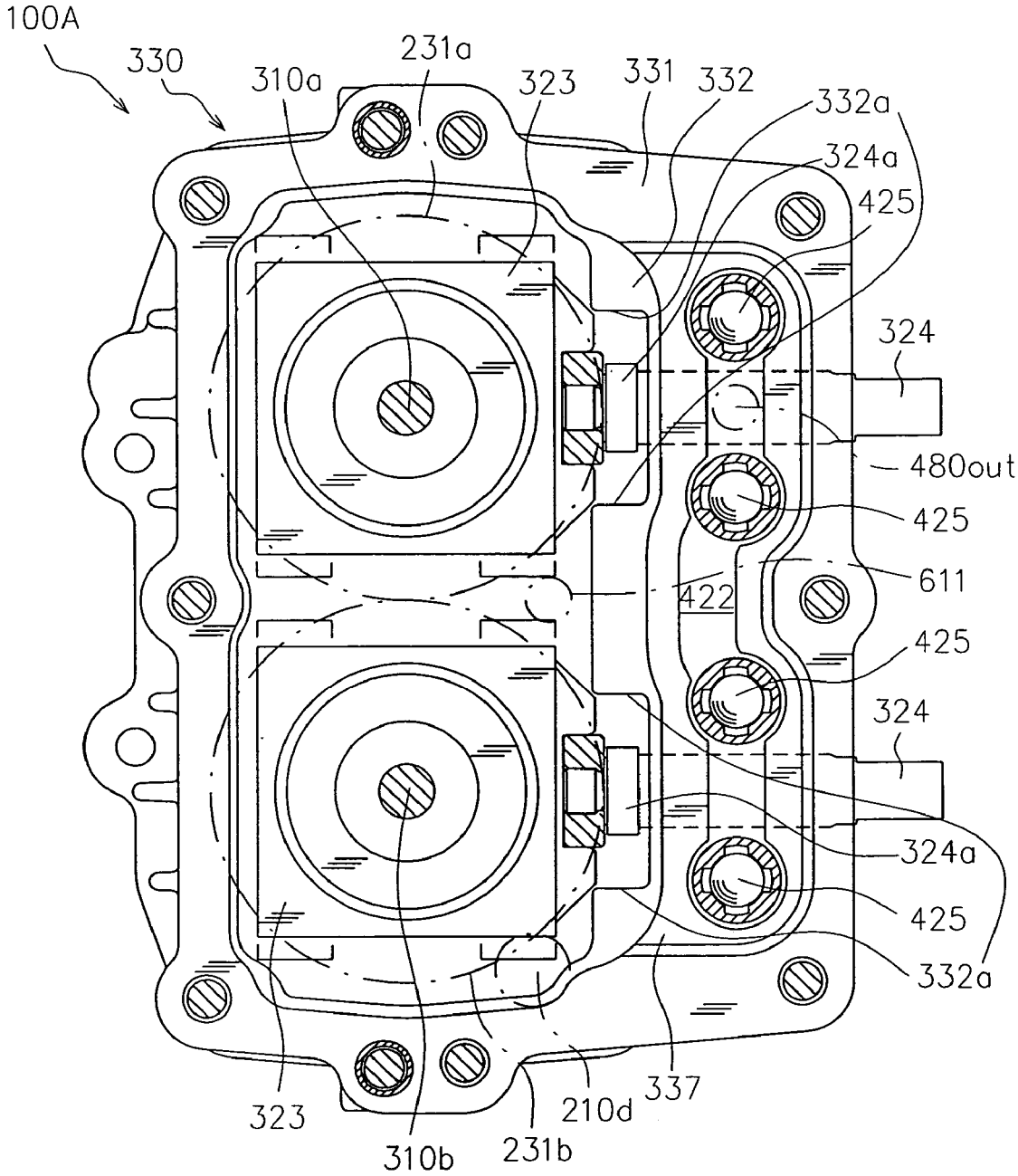
FIG. 6 is an end face view taken along line VI-VI in FIG. 5 in a state where cylinder blocks in the hydraulic pump bodies of the pump system are removed.

FIG. 6 is an end face view taken along line VI-VI in FIG. 5, that shows a state where each cylinder block 322 in the first and second hydraulic pump bodies 320*a*, 320*b* is removed.

As shown in FIGS. 1 and 6, in this embodiment, the first pump body 320*a* and the second pump body 320*b* are configured so that the respective control shafts 324 extend in the same direction (toward the front of the vehicle in the illustrated embodiment) with respect to each other.

Herein, each control shaft 324 is connected to left and right speed change levers 35 arranged in the vicinity of the driver's seat of the working vehicle 1 via an appropriate link mechanism 39, as shown in FIG. 1.

Preferably, a neutral returning mechanism for biasing the corresponding output adjusting-member 323 to a neutral position (state in which suction/discharge rates are substantially zero) may be arranged for each control shaft 324.

The pump case 200 accommodates the first and second hydraulic pump bodies and the power transmission mechanism and, also, supports the first and second pump shafts in a rotatable manner about the axis line, as described above.

In this embodiment, the pump case 200 includes a case body 330 for surrounding the first and second hydraulic pump bodies 320*a*, 320*b*, a port block (or center section) 340 which is formed with supply/discharge oil passages for the first and second hydraulic pump bodies 320*a*, 320*b* and is detachably connected to the case body 330, and a lid member 350 detachably coupled to the end face opposite the end face connected to the port block 340 of the case body 330.

The case body 330 includes an opening 339 at the end face positioned on the opposite side of the input end 311 of the first pump shaft 310*a*. The opening 339 is configured to allow the first and second hydraulic pump bodies 320*a*, 320*b* are inserted therethrough.

In this embodiment, as shown in FIG. 4, the opening 339 is a single opening that allows both the first and second hydraulic pump bodies 320*a*, 320*b* to be inserted, but may of course be first and second openings through which the first and second hydraulic pump bodies 320*a*, 320*b* can be inserted, respectively.

In this embodiment, the case body 330 is a single case body capable of containing both the first and second hydraulic pump bodies 320*a*, 320*b*, but may be first and second case bodies respectively containing the first and second hydraulic pump bodies 320*a*, 320*b*.

In this embodiment, the case body 330, as shown in FIGS. 4 and 5, has a hollow peripheral wall member 331 which surrounds the periphery of the first and second hydraulic pump bodies 320*a*, 320*b* with both ends in the axis line direction opened, and an end wall member 332 detachably coupled to the peripheral wall member 331 so as to close the opening on one end (opposite the end face formed with the pump body insert opening 339) of the peripheral wall member. The opening on the other end of the peripheral wall member 331 forms the pump body insert opening 339.

As shown in FIG. 5, the peripheral wall member 331 supports the control shaft 324 in a rotatable manner about the axis line.

The end wall member 332 has a concave arc shaped sliding face which supports each output-adjusting member 323 in the first and second hydraulic pump bodies 320*a*, 320*b* in a slidable manner and is provided with a through hole at the central part for allowing the corresponding pump shaft 310*a*, 310*b* to be passed through.

More specifically, the pump case 200 is partitioned by the end wall member 322 into a compartment for accommodating the first and second gears 231*a*, 231*b* and a compartment for accommodating the first and second hydraulic pump bodies 320*a*, 320*b*.

Further, a concave part 332*a* is provided in the end wall member 332 at a location facing the arm 324*a* of the control shaft 324. The tip end of the arm 324*a* is projected into the concave part 332*a*, and when the arm 324*a* oscillates, the tip end is brought into contact with the concave part 332*a*, thus regulating the maximum capacity of the first and second hydraulic pump bodies 320*a*, 320*b*.

In the illustrated embodiment, the peripheral wall member 331 and the end wall member 332 are separate bodies, but the members may of course by integrally formed.

The port block 340 is detachably coupled to the case body 330 so as to close the pump body insert opening 339 in a liquid tight manner.

That is, a space 210 defined by the case body 330 and the port block 340 is used to accommodate the first and second hydraulic pump bodies 320*a*, 320*b* and is also used as an oil reservoir.

The port block 340 supports the first and second pump shafts 310*a*, 310*b* in a rotatable manner about the axis line and, also, has the inner surface on which the first and second hydraulic pump bodies 320*a*, 320*b* rotating about the corresponding pump shaft are brought into contact.

The oil leaking out from the sliding face and the like flows back to the oil reservoir.

The oil passage formed in the port block 340 will be described later.

The lid member 350 is detachably coupled to the case body 330 so as to form a power transmission mechanism accommodating space 220 for accommodating the power transmission mechanism 230 in cooperation with the case body 330.

Specifically, the lid member 350 has a peripheral wall 351 extending in the axis line direction of the first and second pump shafts 310*a*, 310*b*, and an end wall 352 for closing one end side (input end side of the first pump shaft 310*a*) in the axis line direction of the peripheral wall 351, as shown in FIGS. 4 and 5.

The lid member 352 can form the power transmission mechanism accommodating space 220 with the case body 330 by making the other end in the axis line direction of the peripheral wall 351 contact with the end wall member 332 of in the case body 330.

The end wall 352 can support each of the first and second pump shafts 310*a*, 310*b* in a rotatable manner about the axis line.

Specifically, the end wall 352 has thick first and second bearing portions 360*a*, 360*b* at locations corresponding to the first and second pump shafts 310*a* and 310*b*.

As shown in FIGS. 4 and 5, the first bearing portion 360*a* supports the first pump shaft 310*a* in a relatively rotatable manner about the axis line with the input end 311 extending outward.

Specifically, a through hole 361*a* through which the first pump shaft 310*a* is inserted is formed in the first bearing portion 360*a*.

The first bearing portion 360*a* supports the first pump shaft 310*a* in a relatively rotatable manner about the axis line via first and second bearing members 371, 372 arranged in series in the through hole 361*a* so as to lie along the axis line direction of the first pump shaft 310*a*.

The reference numeral 375 in FIGS. 4 and 5 denotes a sealing member for sealing the through hole 361*a* in a liquid tight manner.

On the other hand, the second bearing portion 360*b*, as shown in FIG. 4, supports one end of the second pump shaft 310*b* in a relatively rotatable manner about the axis line via a single bearing member 373.

Specifically, the second bearing portion 360*b* has a concave part 361*b* for surrounding one end of the second pump shaft 310*b*.

The second bearing portion 360*b* supports one end of the second pump shaft 310*b* while surrounding such end in a relatively non-rotatable manner about the axis line via the bearing member 373 arranged in the concave part 361*b*.

That is, in the pump system 100A according to this embodiment, the first pump shaft 310*a* operatively connected to the driving source 40 via the pulley transmission mechanism 280 is supported at one end portion near to the input end 311 by the pump case 200 (lid member 350 in the illustrated embodiment) via a plurality of bearing members (first and second bearing members 371 and 372 in the illustrated embodiment).

Therefore, the deflection of the first pump shaft 310*a* can be prevented as much as possible even when the force in the direction orthogonal to the axis line direction is applied on the first pump shaft 310*a* from the pulley transmission mechanism 280.

That is, in the pulley transmission mechanism 280, the power is transmitted from the driving pulley 45 to the driven pulley 270 with tension applied to the belt 275, which is wound around between the driving pulley 45 and the driven pulley 270, by a tension application member such as a tension roller.

Therefore, the external force in the direction substantially orthogonal to the axis line direction of the first pump shaft 310*a* is applied to the first pump shaft 310*a* that supports the driven pulley 270.

When such an external force is applied, the first pump shaft 310*a* deflects, thereby tilting the sliding surface of the first hydraulic pump body 320*a* with respect to the inner surface (surface facing the first hydraulic pump body 320*a*) of the port block 340, and increasing the amount of operating oil leakage from between the first hydraulic pump body 320*a* and the port block 340.

Such increase in the amount of operating oil leakage lowers the transmission efficiency between the first hydraulic pump body 320*a* and the first hydraulic motor unit 10.

Further, as in this embodiment, when the pump system 100A is used in the travel transmission mechanism of the vehicle, if the amount of operating oil leakage from the first hydraulic pump body 320*a* and the amount of operating oil leakage from the second hydraulic pump body 320*b* differ, the straight advancement of the vehicle is prohibited.

With regard to this point, in this embodiment, the first pump shaft 310*a* applied with the external force from the pulley transmission mechanism 280 is supported to the pump case 200 by a plurality of bearing members of first and second bearing members 371, 372 at a region closer to the input end 311 with a center portion for supporting the first hydraulic pump body 320*a* as the reference, as described above.

Therefore, the deflection of the first pump shaft 310*a* can be suppressed as much as possible, and the disadvantage of the amount of operating oil leakage from the first hydraulic pump body 320*a* increasing with respect to the second hydraulic pump body 320*b* can be effectively prevented.

In addition to the aforementioned configuration, the lid member 350 includes an attachment boss 355 for attaching the pump system 100A to the supporting member such as the vehicle frame 30 in this embodiment.

Figure 7:
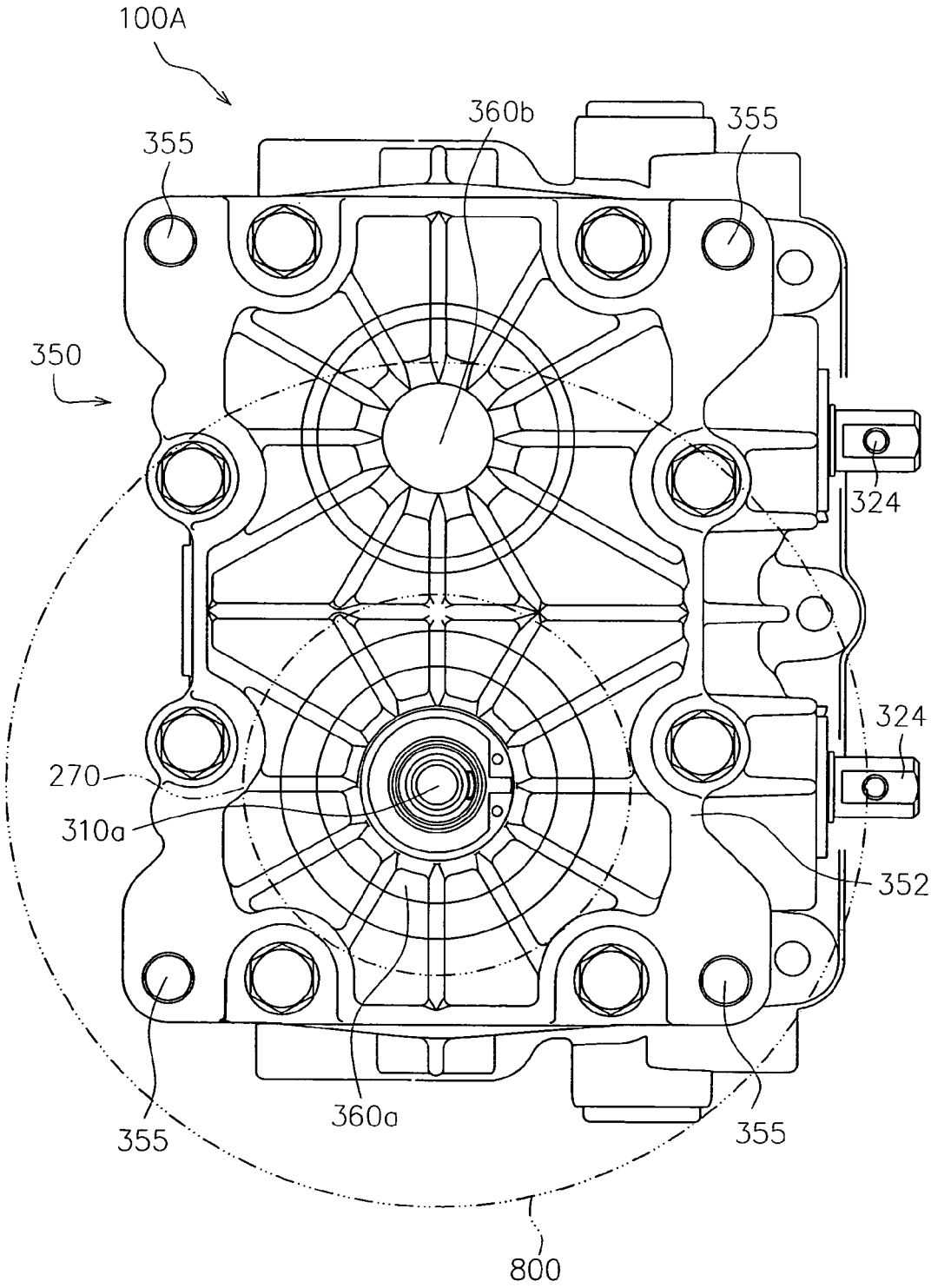
FIG. 7 is an end face view of a pump case of the pump system, taken along line VII-VII in FIG. 5.

FIG. 7 is an end face view of the pump case 200 taken along line VII-VII in FIG. 5.

As shown in FIGS. 5 and 7, the lid member 350 has the attachment bosses 355 extending outward in the radial direction from the first and second bearing portions 360*a* and 360*b*.

In this embodiment, the pump case 200 is connected to the upper face of the cross member 32 via the attachment bosses 355.

The pump case 200 may of course be connected to the lower face of the cross member 32.

The pump system 100A according to this embodiment further includes a charge pump unit 530 driven by the first pump shaft 310*a*.

Specifically, the first pump shaft 310*a* has a second end 312 opposite the input end 311 passing through the port block 340 and extending outward.

The charge pump unit 530 has a charge pump body 500 driven by the second end 312 of the first pump shaft 310*a*, and a charge pump case 510 connected to the outer surface (end face opposite the end face connected to the case body 330) of the port block 340 so as to surround the charge pump body 500.

The charge pump unit 530 is provided to replenish the operating oil to the pair of first operating oil lines 400*a* and the pair of second operating oil lines 400*b*.

Hereinafter, the hydraulic circuit of the pump system 100A according to this embodiment will be described.

As shown in FIG. 3, the pump system 100A includes a pair of first operating oil lines 400*a* for fluidly connecting the first hydraulic pump body 320*a* and the first hydraulic motor unit 10, a pair of second operating oil lines 400*b* for fluidly connecting the second hydraulic pump body 320*b* and the second hydraulic motor unit 20, and a charge line 420 for replenishing the operating oil to the pair of first operating oil lines 400*a* and the pair of second operating oil lines 400*b*.

The pair of second operating oil lines 400*b* have substantially the same configuration as the pair of first operating oil lines 400*a*.

Therefore, with regard to the pair of second operating oil lines 400*b*, the suffix of the reference numbers in the pair of first operating oil lines 400*a* is changed to "b" and the detailed description thereof is omitted.

Figure 8:
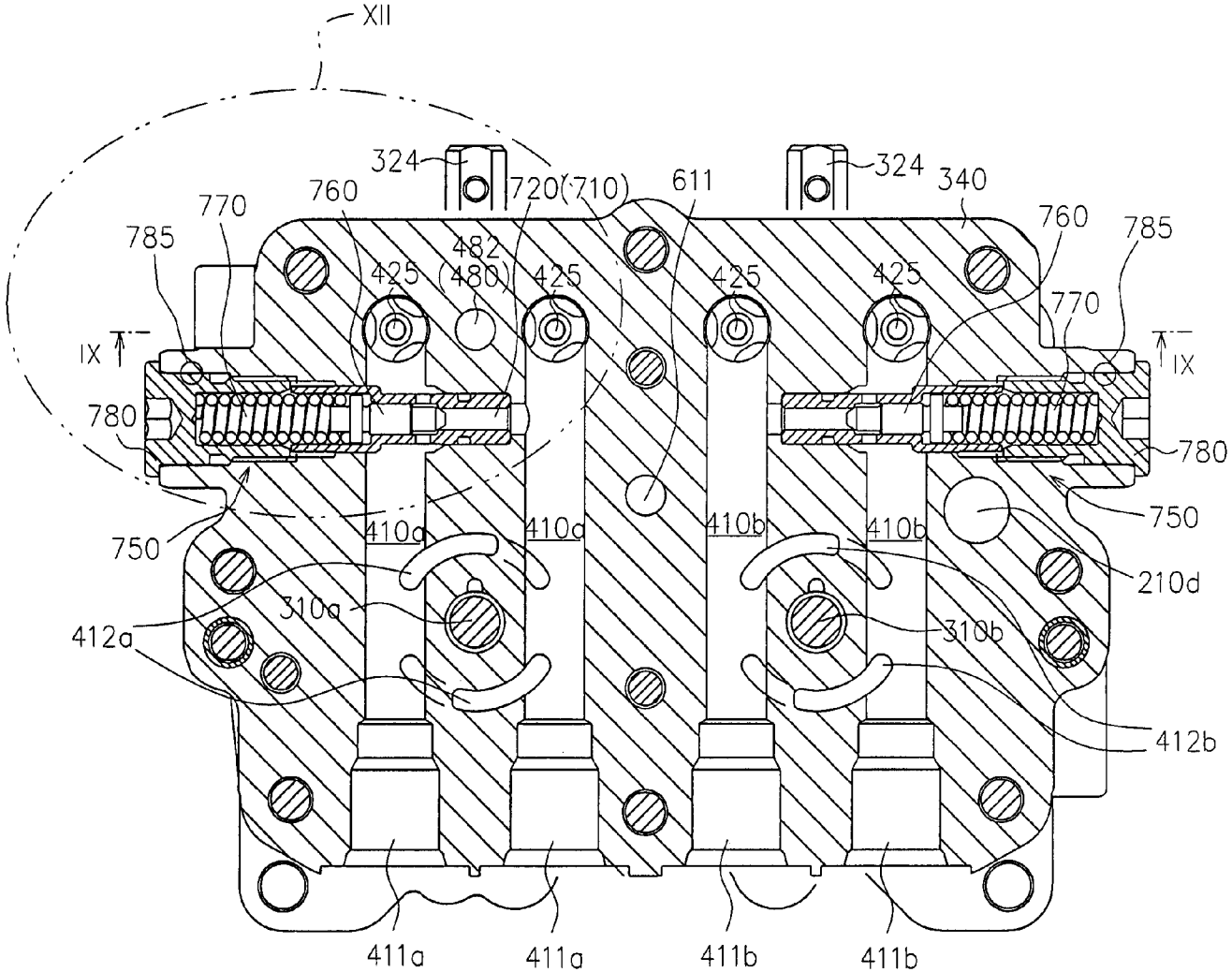
FIG. 8 is a horizontal cross sectional view of a port block of the pump system, taken along line VIII-VIII in FIG. 4.

FIG. 8 is a horizontal cross sectional view of the port block taken along line VIII-VIII in FIG. 4.

Figure 9:
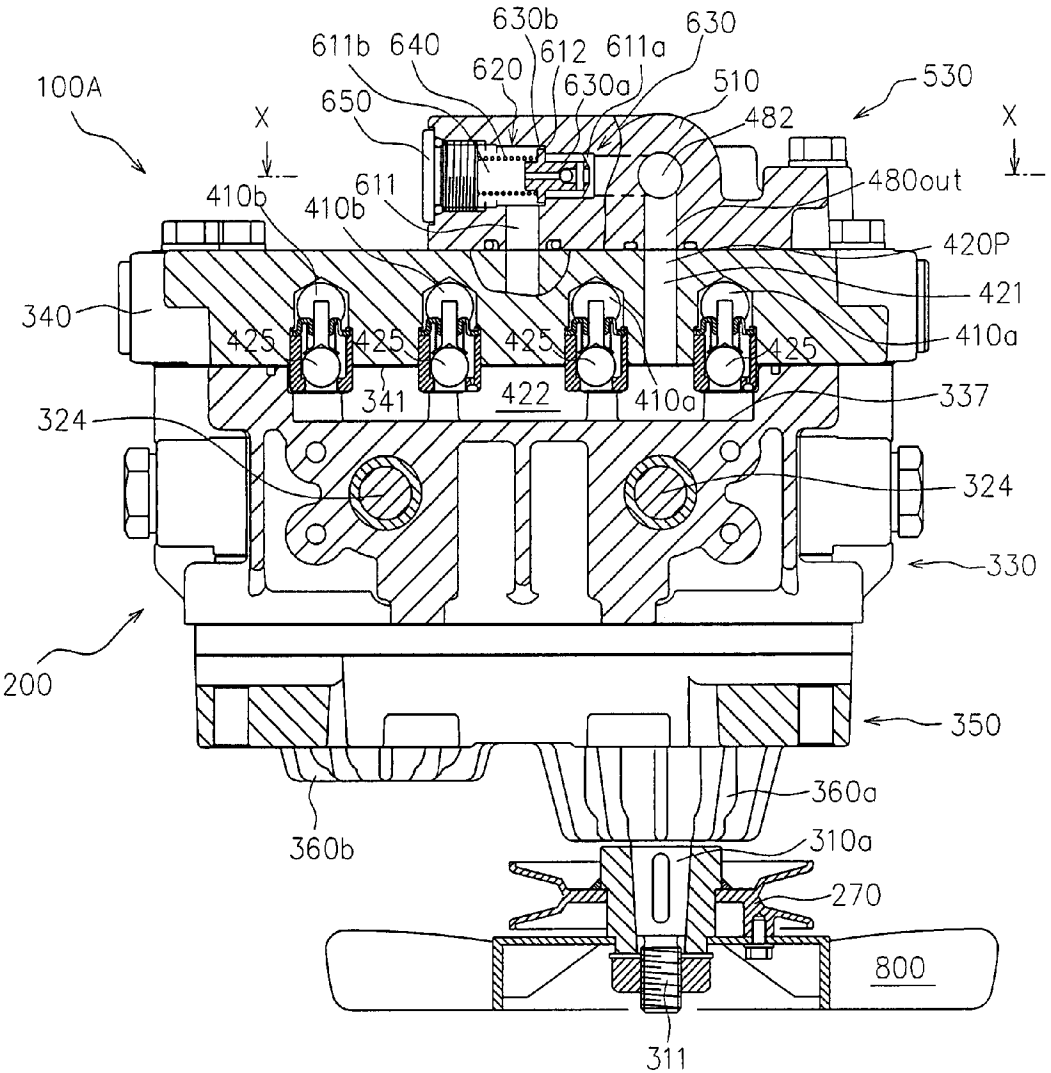
FIG. 9 is a cross sectional view taken along line IX-IX in FIG. 8.

FIG. 9 is a cross sectional view taken along line IX-IX in FIG. 8.

As shown in FIGS. 3 and 8, the pair of first operating oil lines 400*a* has a pair of first operating oil passages 410*a* formed in the port block 340.

Each of the pair of first operating oil passages 410*a* has a first end opened at one side face (rear face in the illustrated embodiment) of the port block 340 to form a pair of first operating oil ports 411*a*, a second end opened at the contact face 341 with the case body 330 in the port block 340 (see FIG. 9), and a middle part between the first and second ends fluidly connected to the suction/discharge port 412*a* of the first hydraulic pump body 320*a* (see FIG. 8).

In this embodiment, the pair of first operating oil passages 410*a* are extended in a direction parallel to the control shaft 324.

The suction/discharge port 412*a* is of a kidney type and is arranged symmetrically in pairs with the corresponding first pump shaft 310*a* as the reference, and opened in the installation face on which the cylinder block 322 is brought into contact.

More specifically, the pair of suction/discharge ports 412*a* are arranged so as to correspond to the direction of the control shaft 324, and are extended in a direction perpendicular to the first operating oil passage 410*a*.

One of the suction/discharge ports 412*a* is formed so that one end side in the longitudinal direction is shallow and the other end side in the longitudinal direction is deep with the central part in the longitudinal direction as a boundary, and thus does not communicate with one of the first operating oil passages 410*a*, and communicates only with the other one of the first operating oil passages 410*a*.

On the other hand, the other of the suction/discharge ports 412*a* is formed so that the other end side in the longitudinal direction is shallow and the one end side in the longitudinal direction is deep with the central part in the longitudinal direction as a boundary, and thus does not communicate with the other one of the first operating oil passages 410*a*, and communicates only with one of the first operating oil passages 410*a*.

As shown in FIG. 3, check valves 425 that allow the oil to flow from the oil reservoir to each of the pair of first operating oil lines 400*a* and the pair of second operating oil lines 400*b*, and that prevent the oil from flowing backward are inserted in the charge line 420.

In this embodiment, the check valves 425 are inserted to the other end of each of the pair of first operating oil passages 410*a* and the pair of second operating oil passages 410*b* from the contact face 341 with the case body 330 of the port block 340, as shown in FIG. 9.

Specifically, in this embodiment, the charge line 420 has a charge oil passage 421 formed in the port block 340, and a concave groove 422 formed at any one of or both of contact faces of the port block 340 and the case body so as to communicate the charge oil passage 421 with the pair of first operating oil passages 410*a* and the pair of second operating oil passages 410*b*, as shown in FIGS. 6 and 9.

Specifically, the charge oil passage 421 has a first end opened at the outer surface of the port block 340 to form the charge port 420P, and a second end opened at the contact face 341 of the port block 340.

The concave groove 422 is formed at any one of or both contact faces of the port block 340 and the case body 330 so as to surround the second end of the charge oil passage 421, the second ends of the pair of first operating oil passages 410*a* and the second ends of the pair of second operating oil passages 410*b*.

As shown in FIG. 9, in this embodiment, the concave groove 422 is formed at the contact face 337 of the case body 330, on which the port block 340 is brought into contact.

The check valves 425 are inserted at each communicating point between the concave groove 422 and the pair of first operating oil passages 410*a*, and at each communicating point between the concave groove 422 and the pair of second operating oil passages 410*b*.

The pump system 100A according to this embodiment includes the charge pump unit 530 as described above, and the pressure oil from the charge pump unit 530 is supplied to the charge line 420.

Specifically, in addition to the aforementioned hydraulic circuit, the pump system 100A has a pressure oil supply line 480 which has a first end fluidly connected to the oil reservoir and a second end fluidly connected to the charge line 420. The charge pump body 500 is inserted into the pressure oil supply line 480, as shown in FIG. 3.

Figure 10:
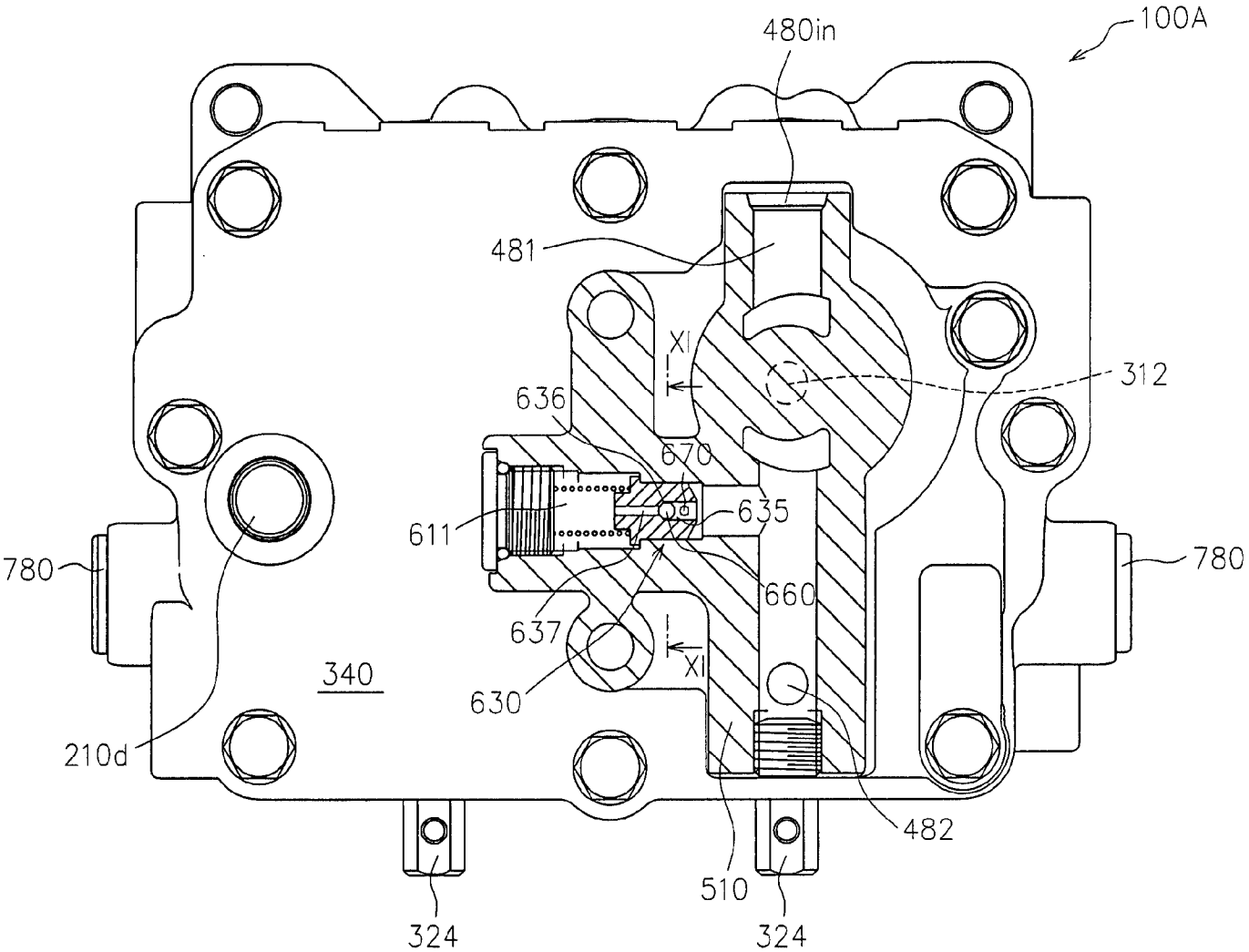
FIG. 10 is a cross sectional view taken along line X-X in FIG. 9.

FIG. 10 is a cross sectional view taken along line X-X in FIG. 9.

As shown in FIGS. 5 and 10, the pressure oil supply line 480 has a suction oil passage 481 and a discharge oil passage 482 formed in the charge pump case 510.

The suction oil passage 481 has a first end opened at one side face of the charge pump case 510 to form an oil draw-in port 480 in and a second end communicated with a suction port of the charge pump body 500 (see FIGS. 3 and 10).

The discharge oil passage 482 has a first end communicated with the discharge port of the charge pump body 500 and a second end opened at a contact face with the port block 340 so as to form an oil draw-out port 480out for communicating with the charge port 420P (see FIGS. 3 and 9).

In this embodiment, the oil draw-in port 480 in is fluidly connected to the oil reservoir via an appropriate conduit.

Specifically, in addition to the aforementioned configuration, the pump system 100A has an external reserve tank 90, as shown in FIG. 2.

The external reserve tank 90 is fluidly connected to the internal space 210 of the pump case 200 via an appropriate conduit and a drain port 210*d*.

That is, in this embodiment, the pump case 200 and the external reserve tank 90 form the oil reservoir.

Preferably, the internal space 210 of the pump case 200 is filled with oil in terms of preventing air mixture. In view of this point, the drain port 210*d* is opened at the upper face of the port block 340 positioned at the uppermost position when the pump case 200 is mounted at the cross member 32; thus, the oil overflowing from the pump case 200 flows back to the external reserve tank 90 via the drain port 210*d* in this embodiment.

The oil draw-in port 480 in is fluidly connected to the external reserve tank 90 forming the oil reservoir via a line filter.

Further, the pump system 100A according to this embodiment includes a charge relief mechanism 600 for setting the oil pressure of the charge line 420.

As shown in FIG. 3, the charge relief mechanism 600 includes an oil pressure setting line 610 having a first end fluidly connected to the charge line 420 and a second end fluidly connected to the oil reservoir, and a charge relief valve 620 inserted in the oil pressure setting line 610.

As shown in FIGS. 9 and 10, in this embodiment, the oil pressure setting line 610 has an oil pressure setting passage 611 formed in the charge case body 330 and the port block 340 so as to have a first end communicated with the discharge oil passage 482 and a second end communicated with the internal space 210 of the pump case 200 as a drain channel.

As shown in FIGS. 9 and 10, the charge relief valve 620 has a relief valve body 630 which is provided in a middle part of the oil pressure setting passage 611 in a movable manner in the axis line direction and divides the oil pressure setting passage 611 into two sides by being seated on a valve seat 612 formed in the oil pressure setting passage 611, and an oil pressure setting relief spring 640 for pressing the relief valve body 630 toward the valve seat 612.

In this embodiment, the relief valve body 630 and the oil pressure setting relief spring 640 are inserted inside the charge pump case 510, but is not limited thereto, and may by arranged within the port block 340.

A spring holding member 650 for compressing and holding the oil pressure setting relief spring 640 so as to have a biasing force corresponding to the charge pressure value to be set is provided in the charge pump case 510 (see FIGS. 9 and 10).

Specifically, the spring holding member 650 is coupled with screws to the charge pump case 510 so as to allow the holding position of the base end of the oil pressure setting relief spring 640 to be adjusted.

The relief valve body 630 is configured so as to be pushed in a direction away from the valve seat 612 against the biasing force of the oil pressure setting relief spring 640 when receiving the oil pressure of the charge line 420.

Specifically, the oil pressure setting passage 611 has a small diameter hole 611*a* which is opened to a first end of the oil pressure setting passage 611 fluidly connecting with the charge line 420, and a large diameter hole 611*b* in which the diameter is increased with the valve seat 612 from the small diameter hole 611*a* and which is opened to a second end of the oil pressure setting passage 611 fluidly connecting with the oil reservoir (internal space 210 of the pump case 200 in the illustrated embodiment).

The relief valve body 630 has a small diameter part 630*a* arranged in the small diameter hole 611*a* in a movable manner in the axis line direction, and a large diameter part 630*b* in which the diameter is increased from the small diameter part 630*a* and which is arranged in the large diameter hole 611*b* so as to be seatable on the valve seat 612.

Figure 11:
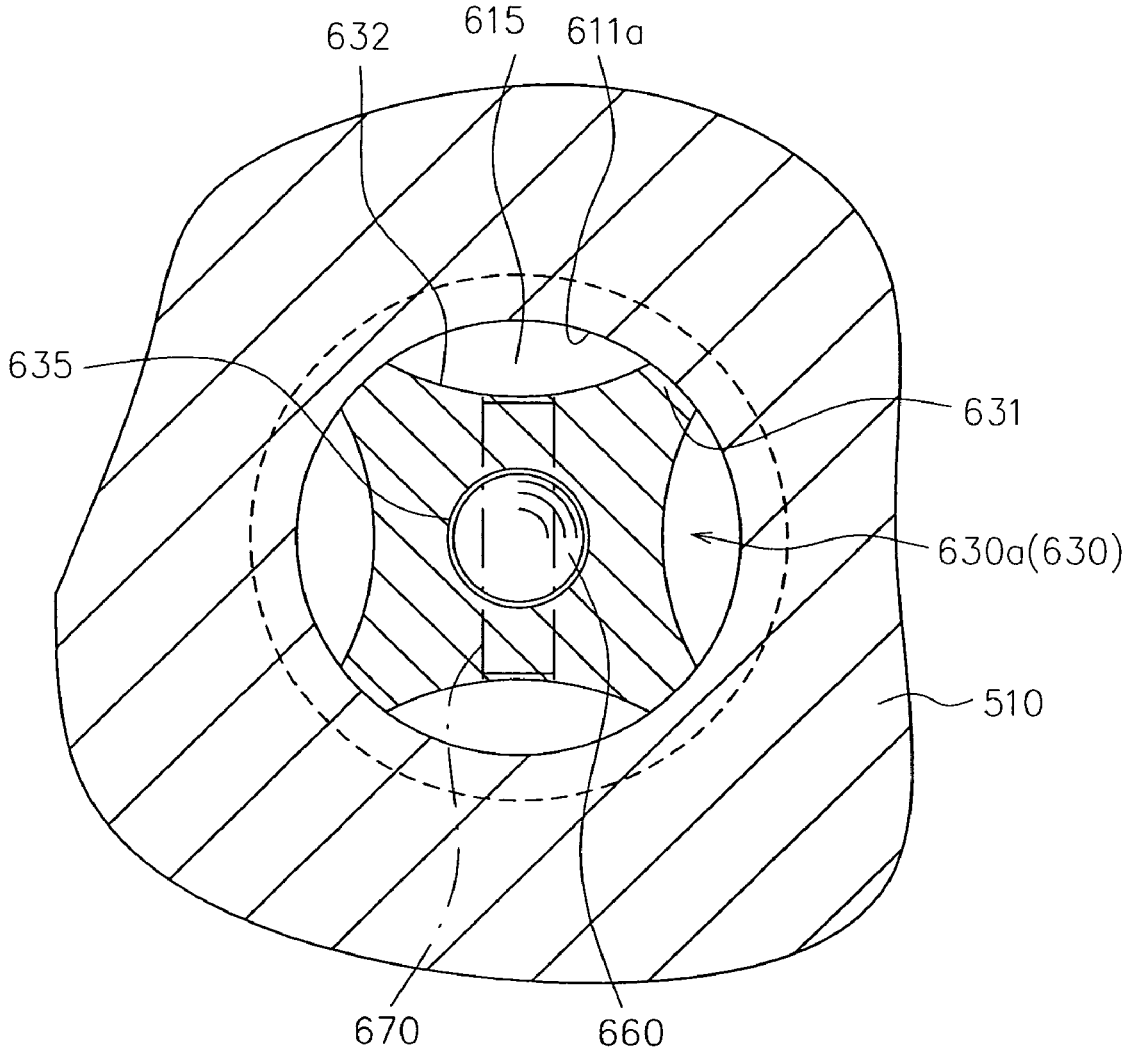
FIG. 11 is a cross sectional view taken along line XI-XI in FIG. 10.

FIG. 11 is a cross sectional view taken along line XI-XI in FIG. 10.

As shown in FIG. 11, in this embodiment, the small diameter part 630*a* is provided with a guide part 631 slidably brought into contact with the inner peripheral face of the small diameter hole 611*a*, and a concave part 632 defining an oil groove 615 with the inner peripheral face of the small diameter hole 611*a*. The oil groove 615 becomes the oil channel in the relief action.

As shown in FIG. 3, the charge relief mechanism 600 further has a check action for allowing the oil to flow from the oil reservoir to the charge line 420 and, also, preventing the oil from flowing backward.

To be concrete, as shown in FIG. 10, the relief valve body 630 is provided with a check large diameter hole 635 which is opened to the first end of the oil pressure setting passage 611 fluidly connecting with the charge line 420, a check small diameter hole 637 which communicates with the check large diameter hole 635 and which is opened to the second end of the oil pressure setting passage 611 fluidly connecting with the oil reservoir, and a check valve seat 636 between the check large diameter hole 635 and the check small diameter hole 637.

The check large diameter hole 637 is provided with a check valve body 660 which is seatable on the check valve seat 636 and is movable in the axis line direction, and a slip-out prevention member 670 which allows the check valve body 660 to selectively communicate or seal between the check large diameter hole 635 and the check small diameter hole 637 while preventing the check valve body 660 from being removed from the check large diameter hole 635.

In the charge relief mechanism 600 of this configuration, in addition to the oil pressure setting operation for setting the oil pressure of the charge line 420, if one of the pair of first operating oil lines 400*a* or one of the pair of second operating oil lines 400*b* becomes a negative pressure when the charge pump body 500 is stopped, the oil is self-primed from the oil reservoir to the operating oil line of negative pressure.

That is, when the engine 40 is stopped at an HST neutral state and the working vehicle is parked on the hill or the like, for example, the rotating force applies to the motor shaft operatively connected to the driving wheel 40, and the hydraulic motor units 10, 20 attempt to perform the pump action.

When the pair of first operating oil lines 400*a* and the pair of second operating oil lines 400*b* are filled with operating oil in this state, the braking force acts on the hydraulic motor units 10, 20 by the operating oil. However, one of the pair of first operating oil lines 400*a* and one of the pair of second operating oil lines 400*b* become a high pressure due to the pump action of the hydraulic motor units 10, 20, and the operating oil may leak out from the operating oil line of high pressure.

When such leak of the operating oil occurs, circulation of oil from the operating oil line on the negative side to the operating oil line on the high pressure side occurs at each of the pair of first operating oil lines 400*a* and the pair of second operating oil lines 400*b*, and the operating oil leakage from the operating oil line on the high pressure side is promoted. Eventually, the operating oil no longer exists in the pair of first operating oil lines 400*a* and the pair of second operating oil lines 400*b*, and the driving wheel starts to rotate freely, and the vehicle starts to move down the hill (free wheel phenomenon).

With regard to this point, in the charge relief mechanism 600, when one of the pair of first operating oil lines 400*a* or one of the pair of second operating oil lines 400*b* becomes a negative pressure, the oil is supplied from the oil reservoir (internal space 210 of the pump case 200 in the illustrated embodiment) to the operating oil line of negative pressure through the oil pressure setting passage 611.

Therefore, the free wheel phenomenon can be effectively prevented.

As shown in FIG. 3, the pump system 100A according to this embodiment includes a first oil pressure control mechanism 700*a* for relieving the pressure oil of the high pressure side (e.g., 400*a*(1)) to the other low pressure side (e.g., 400*a*(2)) in case that the oil pressure on the high pressure side of the pair of first operating oil lines 400*a* exceeds a maximum value (predetermined value) of the pressure range expected during work when the HST is in the working state, and a second oil pressure control mechanism 700*b* for relieving the pressure oil of the high pressure side (e.g., 400*b*(1)) to the other low pressure side (e.g., 400*a*(2)) in case that the oil pressure on the high pressure side of the pair of second operating oil lines 400*b* exceeds a maximum value (predetermined value) of the pressure range expected during work when the HST is in the working state.

The second oil pressure control mechanism 700*b* has substantially the same configuration as the first oil pressure control mechanism 700*a*.

Therefore, with regard to the second oil pressure control mechanism 700*b*, the suffix of the reference numbers in the first oil pressure control mechanism 700*a* is changed to "b" and the detailed description thereof is omitted.

As shown in FIG. 3, the first oil pressure control mechanism 700*a* includes a relief line 710 for communicating the pair of first operating oil lines 400*a*, and a relief valve 750 inserted in the relief line 710.

Figure 12:
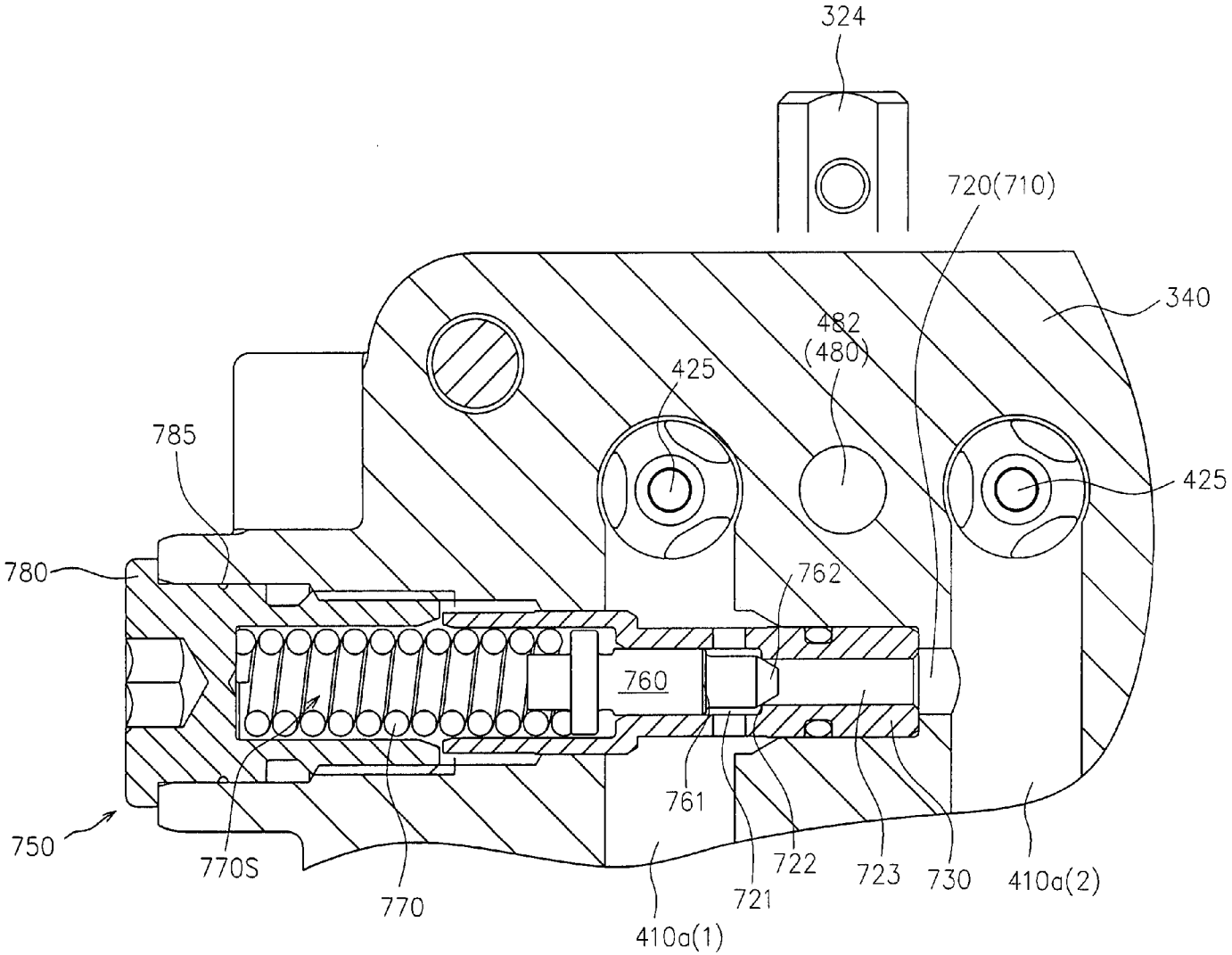
FIG. 12 is an enlarged view of a XII part in FIG. 8.

FIG. 12 is an enlarged view of a XII part in FIG. 8.

As shown in FIGS. 8 and 12, in this embodiment, the relief line 710 has a relief oil passage 720 formed in the port block 340 so as to communicate the pair of first operating oil passages 410*a*.

Specifically, in this embodiment, the pair of first operating oil passages 410*a* extend substantially parallel to each other with the corresponding first pump shaft 310*a* interposed therebetween (see FIG. 8).

The relief oil passage 720 extends in a direction substantially orthogonal to the pair of first operating oil passages 410*a* and has a first end opened at one side face of the port block 340.

As shown in FIG. 12, the relief oil passage 720 has a large diameter hole 721 which is opened to one 410*a*(1) of the pair of first operating oil passages 410*a*, and a small diameter hole 723 which communicates with the large diameter hole 721 and is opened to the other one 410*a*(2) of the pair of first operating oil passages 410*a*, and a valve seat 722 formed between the large diameter hole 721 and the small diameter hole 723.

In this embodiment, the large diameter hole 721, the valve seat 722 and the small diameter hole 723 are formed in the holder member 730 which is inserted in the relief oil passage 720 from the opening on one end side of the relief oil passage 720.

As shown in FIGS. 8 and 12, the relief valve 750 includes a relief valve body 760 which is inserted inside the relief oil passage 720 (holder member 730 in the illustrated embodiment) in a movable manner in the axis line direction and blocks the relief oil passage 720 by being seated on the valve seat 722, a relief spring 770 in which the tip end is engaged with the relief valve body 760 so as to press the relief valve body 760 toward the valve seat 722, and a spring holding member 780 having a face engaged with the base end of the relief spring 770.

The relief valve body 760, as best shown in FIG. 12, has a first pressure receiving face 761 for pushing the relief valve body 760 in a direction away from the valve seat 722 against the biasing force of the relief spring 770 upon receiving the oil pressure of one 410*a*(1) of the pair of first operating oil passages 410*a*, and a second pressure receiving surface 762 for pushing the relief valve body 760 in a direction away from the valve seat 722 against the biasing force of the relief spring 770 upon receiving the oil pressure of the other one 410*a*(2) of the pair of first operating oil passages 410*a*.

That is, the relief valve body 760 is pushed against the biasing force of the relief spring 770 when the oil pressure of one 410*a*(1) of the pair of first operating oil passages 410*a* exceeds the relief pressure defined by the relief spring 770, thereby allowing the pressure oil relief from one 410*a*(1) of the pair of first operating oil passages 410*a* to the other one 410*a*(2) of the pair of first operating oil passages 410*a*. Further, the relief valve body 760 is pushed against the biasing force of the relief spring 770 when the oil pressure of the other one 410*a*(2) of the pair of first operating oil passages 410*a* exceeds the relief pressure, thereby allowing the pressure oil relief from the other one 410*a*(2) of the pair of first operating oil passages 410*a* to the one 410*a* (1) of the first operating oil passages 410*a*.

The spring holding member 780 is configured to be inserted from the opening on one end side of the relief oil passage 720 and hold the end of the relief spring 770 in a position adjustable manner in the axis line direction in the relief oil passage 720.

That is, the spring holding member 780 can variably set a accommodating space 770S for the relief spring 770 defined by the axial position of the base end of the relief spring 770.

In this embodiment, the spring holding member 780 is screwed into the relief oil passage 720 and is tightened/loosened using by a predetermined tool. The spring holding member 780 is configured to form an initial space for holding the relief spring 770 in a state that the biasing force corresponding to the relief pressure set value is generated by maximally tightening the spring holding member 780.

Preferably, the spring holding member 780 is further configured to expand the space 770S and hold the relief spring 770 in a state equal to or more than the free length by loosening while still maintaining the screw coupled state.

That is, in this embodiment, the spring holding member 780 is configured to have the relief spring 770 in a free length state while closing the opening on one end side of the relief oil passage 720 by changing the relative position thereof with respect to the relief oil passage 720.

Therefore, by having the relief spring 770 in the free length state, when towing the vehicle 1A mounted with the travel speed change transmission mechanism including the hydraulic pump system 100A due to engine trouble and the like, the hydraulic resistance does not occur since the oil pressure generated from the hydraulic motors 10, 20 mutually flows through the first operating oil passages 410*a*, 410*a* via the relief oil passage 720 without flowing through the hydraulic pump bodies 320*a*, 320*b*.

In the first oil pressure control mechanism 700 of this configuration, the relief action of relieving the oil pressure on the high pressure side toward the low pressure side in case that one of the pair of first operating oil passages 410*a* is in an abnormal high pressure state, and the bypass action of bypassing between the pair of first operating oil passages 410*a* on a constant basis can be selected, by simply adjusting the relative position of the spring holding member 780 with respect to the relief oil passage 720.

More preferably, a mark 785 indicating that the relief spring 770 is sufficiently in the free length state is arranged on the outer peripheral surface of the spring holding member 780 so as to be visually recognizable. Thus, the accidental fall of the spring holding member 780 due to over-loosening can be prevented. The mark 785 can be, for example, provided on the entire periphery of the outer peripheral surface of the spring holding member 780.

To be concrete, the mark 785 is arranged at a position which is exposed outside from the relief oil passage 720 when the spring holding member 780 holds the relief spring 770 in the free length state (see FIGS. 8 and 12).

Figure 13:
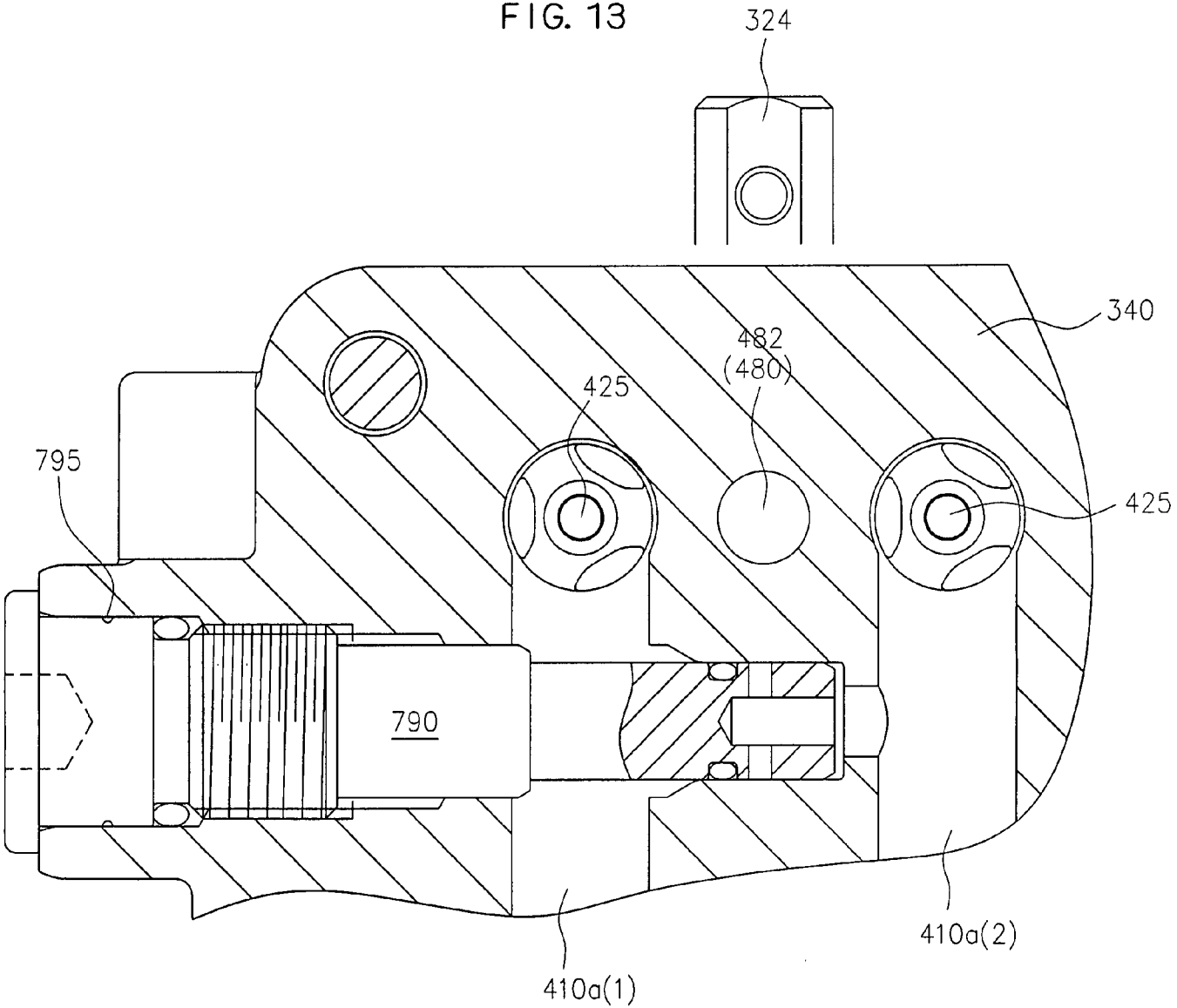
FIG. 13 is an enlarged view of the XII part in FIG. 8 in a state where a regular bypass valve is employed instead of the oil pressure control mechanism according to the present invention.

In this embodiment, the first and second oil pressure control mechanisms 700*a* and 700*b* are provided, but instead, a regular bypass valve 790 may be provided as shown in FIG. 13.

That is, modification can be very easily carried out by inserting the bypass valve 790 in the relief oil passage 720 in place of the holder 730 and the relief valve 750.

The reference number 795 in FIG. 13 denotes a mark for indicating that the bypass state is achieved.

Embodiment 2

A preferred embodiment of a pump system 100B according to the present invention will now be described with reference to the accompanying drawings.

In this embodiment, the same reference characters are denoted for the members same as or corresponding to those of the first embodiment, and thus the detailed description thereof is omitted.

Figure 14:
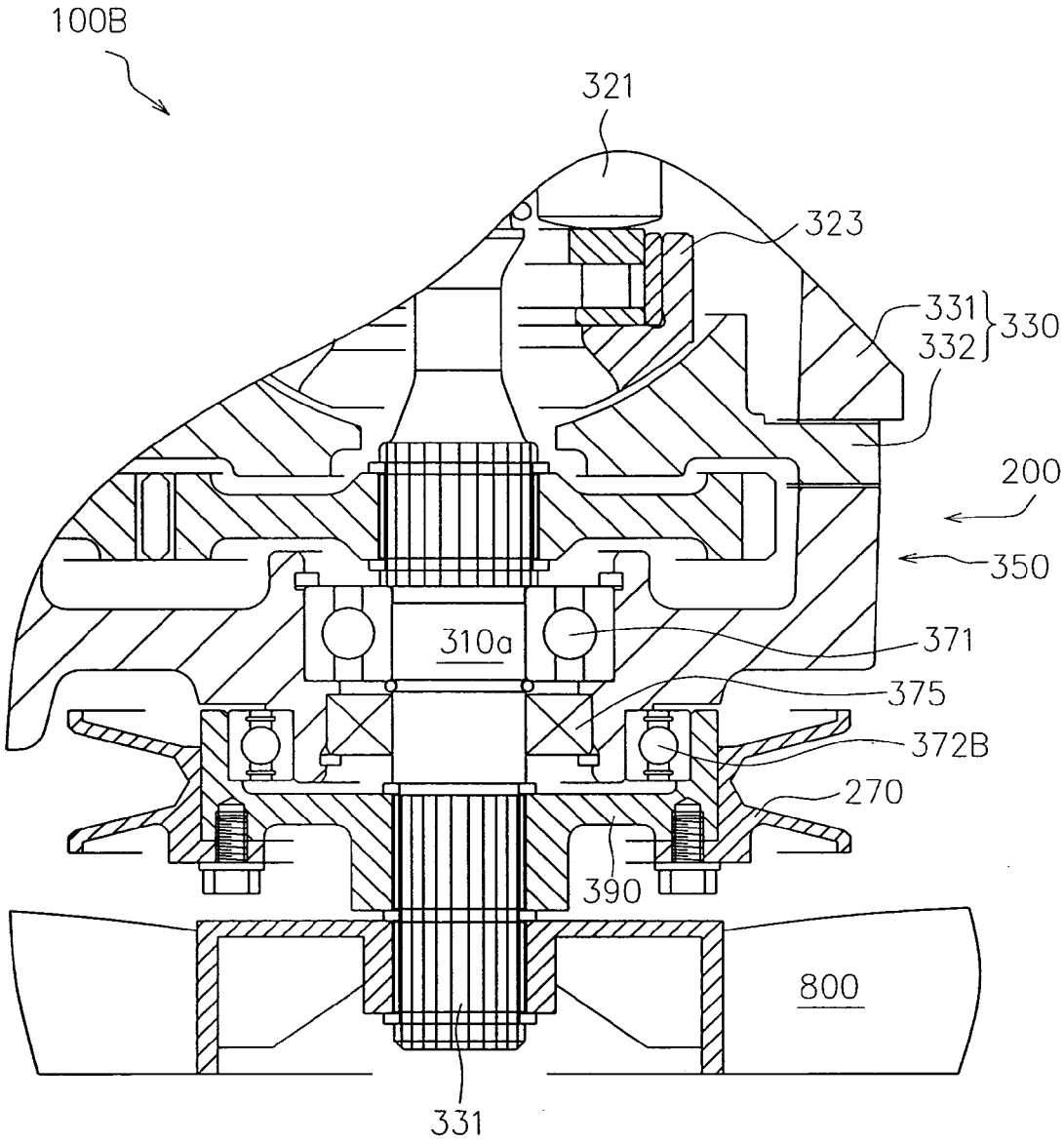
FIG. 14 is a partial longitudinal sectional view of the pump system according to a second embodiment of the present invention.

FIG. 14 is a partial longitudinal sectional view of the pump system 100B according to this embodiment.

As shown in FIG. 14, the pump system 100B according to this embodiment differs from the pump system 100A according to the first embodiment only with regard to the supporting structure of the first pump shaft 310*a*, and the other configurations are substantially the same.

To be concrete, the pump system 100B includes a second bearing member 372B in place of the second bearing member 372 in the pump system 10A.

That is, in the pump system 100B according to this embodiment, the first pump shaft 310*a* is indirectly supported at the pump case 200 via the first bearing member 371 and the second bearing member 372B.

More specifically, the second bearing member 372B supports the driven pulley 270, which is supported in a relatively non-rotatable manner at the first pump shaft 310*a*, in a relatively rotatable manner with respect to the pump case 200.

In the illustrated embodiment, a holder 390 spline connected to the input end 311 of the first pump shaft 310*a* is provided, and the driven pulley 270 is connected to the holder 390. The holder 390 is supported in a rotatable manner to the pump case 200 via the second bearing member 372B.

Further, in this embodiment, the cooling fan 800 is spline connected to the first pump shaft 310*a*, but the cooling fan 800 may of course be connected to the driven pulley 270 as the first embodiment.

In the pump system 100B of this configuration as well, even if the belt tension and the like of the pulley transmission mechanism is applied, the deflection of the first pump shaft 310*a* can be suppressed as much as possible, and thus the operating oil leak from between the first hydraulic pump body 320*a* driven by the first pump shaft 310*a* and the port block 340 can be prevented as much as possible.

Embodiment 3

A preferred embodiment of a pump system 100C according to the present invention will now be described with reference to the accompanying drawings.

In this embodiment, the same reference characters are denoted for the members same as or corresponding to those of the first and second embodiments, and thus the detailed description thereof is omitted.

Figure 16:
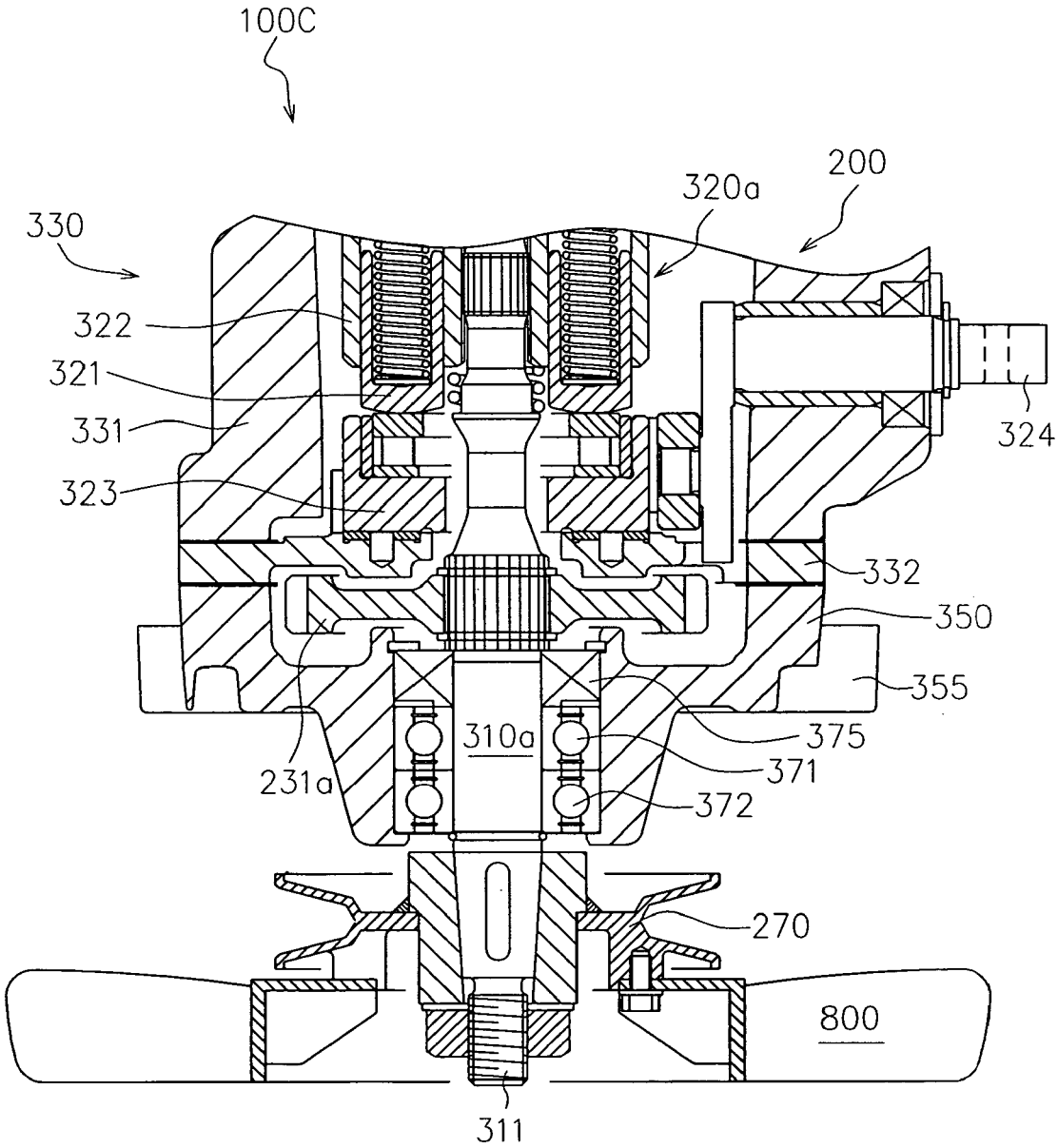
FIG. 16 is a partial longitudinal sectional view of the pump system according to a third embodiment of the present invention.

FIG. 16 is a partial longitudinal sectional view of the pump system 100C according to this embodiment.

In the pump system 100C, the positions of the first and second bearing members 371, 372, and the position of the sealing member 375 are different from those in the pump system 100A.

That is, in the pump system 100A according to the first embodiment, the sealing member 375 is arranged on the outermost part of the through hole 361*a*, and the first and second bearing members 371, 372 are arranged toward the inside of the pump case 200 than the sealing member 375, as shown in FIGS. 4 and 5.

In the pump system 100C according to this embodiment, on the other hand, the first and second bearing members 371, 372 are arranged toward the outside than the sealing member 375, as shown in FIG. 16.

By positioning the first and second bearing members 371, 372 toward the outside than the sealing member 375, the bearing position (arranging position of the first and second bearing members 371, 372) at which the first pump shaft 310*a* is supported, and the external force acting position (arranging position of the driven pulley 270 in this embodiment) at which the first pump shaft 310*a* is applied an external force, are brought closer, thereby increasing the supporting strength of the first pump shaft 310*a*.

In this embodiment, as shown in FIG. 16, both the first and second bearings 371, 372 are positioned toward the outside than the sealing member 375, but as shown in FIG.

17, only one of the first and second bearing members 371, 372 (second bearing member 372 in the illustrated embodiment) may be positioned toward outside than the sealing member 375, and the other one of the first and second bearing members 371, 372 may be positioned toward the inside than the sealing member 375.

Figure 17:
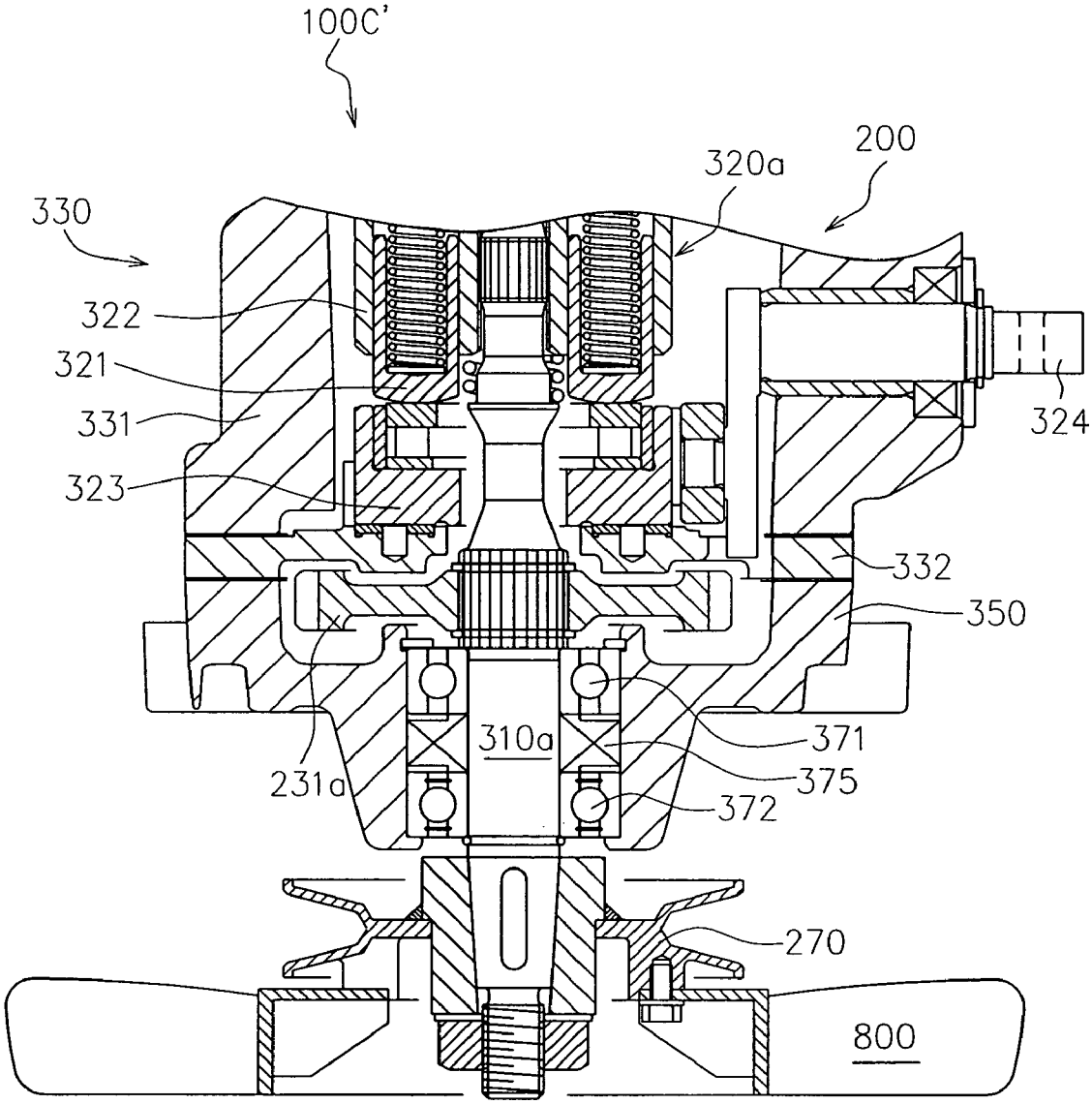
FIG. 17 is a partial longitudinal sectional view of the modified pump system according to the third embodiment of the present invention.

As shown in FIGS. 16 and 17, in a state in which at least one bearing member of the plurality of bearing members 371, 372 for supporting the first pump shaft 310*a* is arranged outside of the sealing member 375, the bearing member (hereinafter, referred to as an outer bearing member) arranged outside of the sealing member 375 is preferably a grease prelubricated bearing member.

That is, the bearing member positioned inside of the sealing member 375 is lubricated by the reserved oil of the pump case 200, but the outer bearing member can not receive the lubricating action by the reserved oil.

Therefore, by the outer bearing member (first and second bearing members 371, 372 in FIG. 16, and the second bearing member 372 in FIG. 17) is formed as a grease prelubricated bearing member, the noise and wear can be effectively prevented and reduced.

In the aforementioned embodiments, the charge pump unit 530 driven by the first pump shaft 310*a* is provided, but instead or in addition thereto, the charge pump unit driven by the second pump shaft 310*b* may be provided.

Further, instead of or in addition to the charge pump unit, an auxiliary pump unit for supplying the operating oil to an external working machine may be provided.

Figure 15:
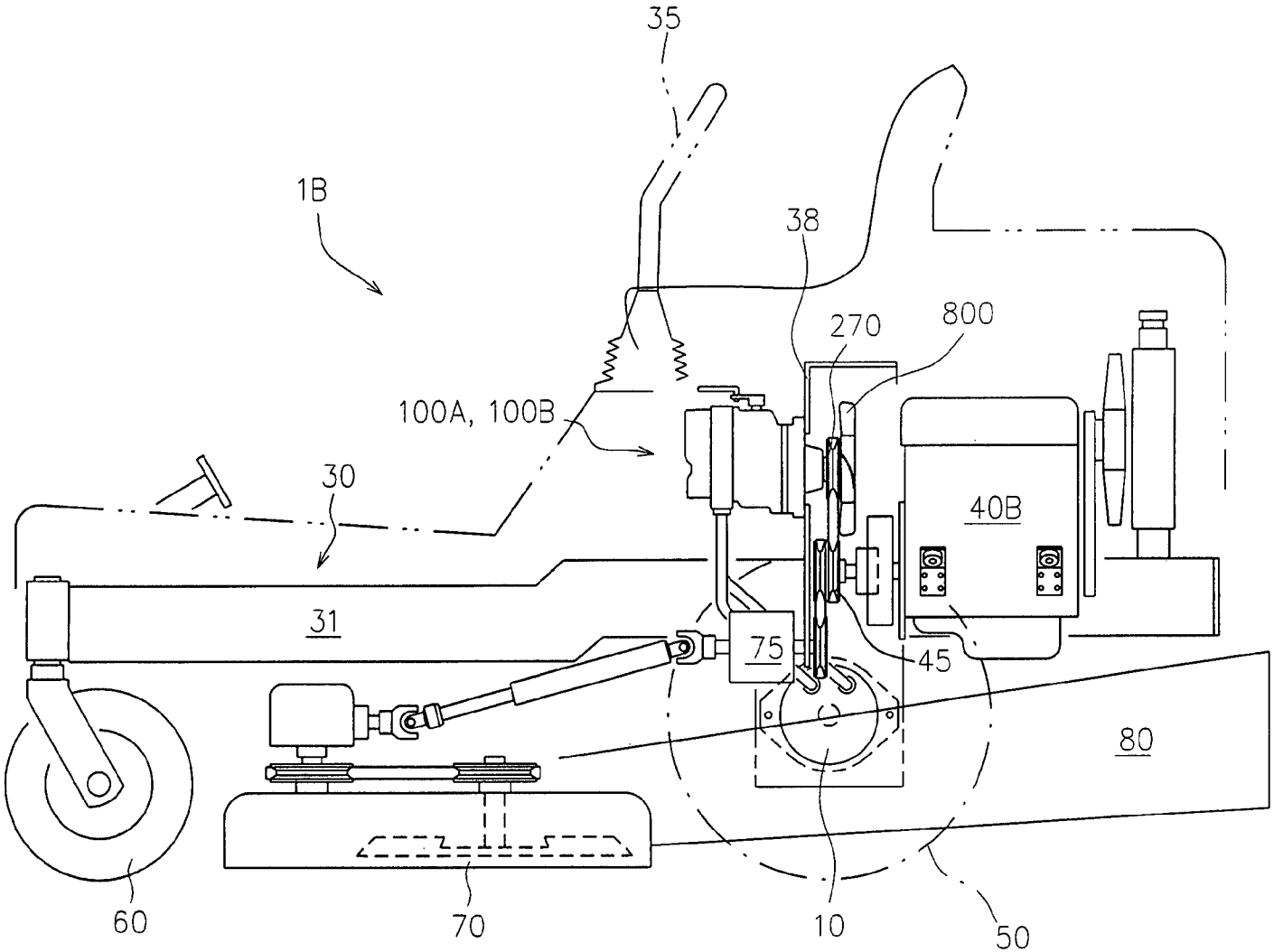
FIG. 15 is a side view of another working vehicle to which a pump system according to the present invention is applied.

In the aforementioned embodiments, the pump systems 100A-100C are mounted to the vehicle frame 30 so that the first and second pump shafts 310*a*, 310*b* extend along the vertical direction to efficiently operatively connect with the driving source 40 including a driving shaft extending vertically, but the pump systems 100A-100C may of course be mounted to a support member such as the vehicle frame 30 so that the first and second pump shafts 310*a*, 310*b* extend horizontally to efficiently operatively connect with the driving source 40B including a driving shaft extending horizontally (see FIG. 15).

For example, the pump system 100A-100C may be applied to the working vehicle 1B shown in FIG. 15. The working vehicle 1B includes a partition wall 38 fixed to a pair of left and right main frames 31, 32 so that the supporting face extends in the vertical direction, and the pump systems 100A-100C are connected to the partition wall 38 so that pump shafts 310*a*, 310*b* extend horizontally.

In the embodiment shown in FIG. 15, the driving source 40B includes two-series of pulleys, which are respectively for a travel system and a PTO system, on the driving shaft thereof. One of which pulley serves as the driving pulley 45, and similar to the aforementioned embodiment, the belt is wound around the driving pulley 45 and the input driven pulley 270 of the pump systems 100A-100C and applied with tension. The reference character 75 of FIG. 15 is a PTO clutch inserted in the PTO transmission mechanism.

This specification is by no means intended to restrict the present invention to the preferred embodiments set forth therein. Various modifications to the pump system, as well as the charge relief mechanism and the oil pressure control mechanism as described herein, may be made by those skilled in the art with out departing from the spirit and scope of the present invention as defined in the appended claims.

What is claimed is:

1. A pump system comprising:

first and second hydraulic pump bodies arranged in parallel;

first and second pump shafts respectively supporting the first and second hydraulic pump bodies in a relatively non-rotatable manner;

a power transmission mechanism including a first gear supported by the first pump shaft in a relatively non-rotatable manner and a second gear supported by the second pump shaft in a relatively non-rotatable manner in a state of engaging with the first gear; and a pump case that accommodates the first and second hydraulic pump bodies and the power transmission mechanism and that supports the first and second pump shafts in a rotatable manner about respective axis lines, the pump case including a port block formed with supply/discharge oil passages for the first and second pump bodies, wherein the first pump shaft includes a center portion supporting the first hydraulic pump body and the first gear, and a first end extending toward one side from the center portion along its axial direction and projecting outward from the pump case via a through hole formed in the pump case so as to support a pulley operatively connected to a driving source, the second pump shaft includes a center portion supporting the second hydraulic pump body and the second gear, and a first end extending toward one side from the center portion along its axial direction so as to be positioned on a same side as the first end of the first pump shaft, the first pump shaft, which receives rotational power from the driving source via the pulley supported on the first end, has a portion positioned between the center portion and the first end and supported by the pump case through first and second bearing members arranged in series to each other along the axial direction within the through hole, the second pump shaft, which receives rotational power from the first pump shaft through the power transmission mechanism, has a portion positioned between the center portion and the first end and supported by the pump case through a single bearing member, at least one bearing member of the first and second bearing members is positioned outward in the axial direction of the first pump shaft than a sealing member disposed in the through hole.

2. A pump system according to claim 1, wherein each of the first and second bearing members includes an outer race body, an inner race body and a plurality of rolling members interposed between the outer race and the inner race bodies, and the at least one bearing member of the first and second bearing members positioned outward in the axial direction of the first pump shaft than the sealing member is lubricated with grease enclosed within the at least one bearing member.

3. A pump system according to claim 1, wherein the first and second bearing members are respectively positioned inward and outward in the axial direction of the first pump shaft than the sealing member.

4. The pump system according to claim 3, wherein each of the first and second bearing members includes an outer race body, an inner race body and a plurality of rolling members interposed between the outer race and the inner race bodies, and the first bearing member is lubricated with oil stored in the pump case, and the second bearing member is lubricated with grease enclosed therein.

* * * * *